US012454389B2

(12) United States Patent
Richardson et al.

(10) Patent No.: US 12,454,389 B2
(45) Date of Patent: Oct. 28, 2025

(54) PORTABLE COLLAPSIBLE MODULAR AND WATERPROOF STORAGE AND TRANSPORTATION SYSTEM

(71) Applicant: RUX BOX CORPORATION, Vancouver (CA)

(72) Inventors: Anthony David Richardson, Squamish (CA); Andre Charland, Whistler (CA)

(73) Assignee: RUX BOX CORPORATION, Vancouver (CA)

( * ) Notice: Subject to any disclaimer, the term of this patent is extended or adjusted under 35 U.S.C. 154(b) by 54 days.

(21) Appl. No.: 17/631,260

(22) PCT Filed: Dec. 4, 2020

(86) PCT No.: PCT/CA2020/000139

§ 371 (c)(1),
(2) Date: Jan. 28, 2022

(87) PCT Pub. No.: WO2021/108890

PCT Pub. Date: Jun. 10, 2021

(65) Prior Publication Data

US 2022/0274737 A1 Sep. 1, 2022

Related U.S. Application Data

(60) Provisional application No. 62/944,872, filed on Dec. 6, 2019.

(51) Int. Cl.
*B65D 21/08* (2006.01)
*A45C 7/00* (2006.01)
(Continued)

(52) U.S. Cl.
CPC ..... *B65D 21/086* (2013.01); *A45C 7/0036* (2013.01); *A45C 7/0063* (2013.01);
(Continued)

(58) Field of Classification Search
CPC ..... A45C 2013/223; A45C 7/0022; A45C 7/0036; A45C 7/0063; B65D 21/086;
(Continued)

(56) References Cited

U.S. PATENT DOCUMENTS 1,155,475 A 10/1915 Fay
1,192,091 A * 7/1916 Miller ..... B65D 15/22 220/9.1

(Continued)

FOREIGN PATENT DOCUMENTS

CA 2433251 A1 12/2004
DE 202005005750 U1 * 7/2005 ..... A45C 7/0036

(Continued)

OTHER PUBLICATIONS

Trooper 20 Cooler. Product [online]. [retrieved on Jan. 28, 2022]. Retrieved from the Internet: <URL: https://www.otterbox.com/en-us/trooper-20/soft-cooler/77-57017.html>.

(Continued)

*Primary Examiner* — Mollie Impink
(74) *Attorney, Agent, or Firm* — Lewellyn Law, PLLC; Stephen Lewellyn

(57) ABSTRACT

A portable, collapsible modular container system for transportation and storage is provided. The containers are modular and can be stacked in either extended or expanded position, collapsed, or a mix thereof. The container system is modular and customizable, and attachments such as wheel, handles, carry straps, tie down straps, and other accessories, may be added or removed at the option of the user.

22 Claims, 29 Drawing Sheets

(51) Int. Cl.

| | |
|---|---|
| ***A45C 7/02*** | (2006.01) |
| ***A45C 13/00*** | (2006.01) |
| ***B65D 25/06*** | (2006.01) |
| ***B65D 25/28*** | (2006.01) |
| ***B65D 25/54*** | (2006.01) |
| ***B65D 43/16*** | (2006.01) |
| *A45C 5/14* | (2006.01) |
| *A45C 13/02* | (2006.01) |
| *A45C 13/06* | (2006.01) |
| *A45C 13/22* | (2006.01) |

(52) U.S. Cl.

CPC ..... *A45C 7/02* (2013.01); *A45C 13/008* (2013.01); *B65D 25/06* (2013.01); *B65D 25/2873* (2013.01); *B65D 25/54* (2013.01); *B65D 43/161* (2013.01); *A45C 5/14* (2013.01); *A45C 2013/026* (2013.01); *A45C 13/06* (2013.01); *A45C 2013/223* (2013.01); *B65D 2525/285* (2013.01)

(58) Field of Classification Search

CPC ..... B65D 2251/1083; B65D 25/20; B65D 2525/285; B65D 43/161

USPC ..... 206/499, 546

See application file for complete search history.

(56) References Cited

U.S. PATENT DOCUMENTS

| | | | | | |
|---|---|---|---|---|---|
| 1,292,091 | A * | 1/1919 | Ernst | F16H 61/40 | 418/169 |
| 2,544,075 | A * | 3/1951 | Ernst | B65D 37/00 | 383/111 |
| 2,575,770 | A * | 11/1951 | Roop | B65D 77/0486 | 220/23.88 |
| 2,880,902 | A | 4/1959 | Owsen | | |
| 3,083,877 | A | 4/1963 | Gash | | |
| 3,939,888 | A | 2/1976 | Scarnato | | |
| 4,314,624 | A * | 2/1982 | Royet | A45C 5/146 | 280/646 |
| 4,703,519 | A | 10/1987 | Krenzel | | |
| 4,773,458 | A | 9/1988 | Touzani | | |
| 5,181,612 | A * | 1/1993 | Liu | F25D 3/08 | 206/542 |
| 5,201,438 | A | 4/1993 | Norwood | | |
| 5,833,095 | A * | 11/1998 | Russell | A45F 5/02 | 224/684 |
| 5,913,448 | A | 6/1999 | Mann | | |
| 6,220,411 | B1 | 4/2001 | Scicluna | | |
| 6,315,151 | B1 | 11/2001 | Hupp | | |
| D461,638 | S | 8/2002 | Kellogg | | |
| 7,021,437 | B2 | 4/2006 | Ghiassi | | |
| 7,347,019 | B1 * | 3/2008 | Shaw | F16F 1/025 | 40/607.01 |
| 7,866,500 | B1 | 1/2011 | Peggs | | |
| 8,070,006 | B2 * | 12/2011 | Austin | B65F 1/1615 | 220/666 |
| 8,127,956 | B2 * | 3/2012 | Krotts | D06F 95/004 | 220/9.4 |
| 8,317,047 | B2 * | 11/2012 | Vanderberg | F25D 3/06 | 220/666 |
| 8,342,348 | B2 * | 1/2013 | Lin | B65D 25/00 | 220/9.4 |
| 8,430,265 | B2 * | 4/2013 | Vanderberg | B65D 21/086 | 220/666 |
| 8,459,489 | B2 | 6/2013 | Potts | | |
| 8,695,839 | B1 * | 4/2014 | Vanderberg | B65D 81/18 | 220/23.91 |
| 9,296,508 | B2 | 3/2016 | Kanfer | | |
| D752,862 | S | 4/2016 | Riddiford | | |
| 9,527,626 | B1 | 12/2016 | Coronado | | |
| D811,744 | S | 3/2018 | Ballou | | |
| 10,017,299 | B2 * | 7/2018 | Quinn | B65D 37/00 | |
| 10,299,552 | B2 * | 5/2019 | Liang | A45C 5/14 | |
| 10,429,116 | B2 * | 10/2019 | Huish | A45C 11/20 | |
| 2002/0126920 | A1 * | 9/2002 | Mogil | A45C 13/02 | 383/110 |
| 2004/0040971 | A1 | 3/2004 | Athalye | | |
| 2006/0119060 | A1 * | 6/2006 | Sullivan | B65D 21/0212 | 280/79.11 |
| 2006/0157358 | A1 * | 7/2006 | Heidel | D06F 95/002 | 206/278 |
| 2006/0180614 | A1 | 8/2006 | Barron | | |
| 2006/0231692 | A1 | 10/2006 | Sabounjian | | |
| 2006/0266754 | A1 | 11/2006 | Carmona | | |
| 2009/0026197 | A1 * | 1/2009 | Chou | A45C 7/0036 | 220/9.2 |
| 2009/0107998 | A1 * | 4/2009 | Meissen | B65F 1/1607 | 220/254.3 |
| 2009/0218342 | A1 * | 9/2009 | Pickles | B65D 25/16 | 220/6 |
| 2012/0267366 | A1 * | 10/2012 | Wang | B65D 25/04 | 220/520 |
| 2015/0217901 | A1 | 8/2015 | Bagley | | |
| 2017/0334603 | A1 * | 11/2017 | Zaremski | D05B 91/12 | |
| 2018/0346229 | A1 | 12/2018 | Gerdrum | | |
| 2023/0257163 | A1 * | 8/2023 | Fleherty | B65D 81/38 | 220/592.2 |

FOREIGN PATENT DOCUMENTS

| | | | | |
|---|---|---|---|---|
| DE | 202009018267 | U1 * | 10/2011 | A45C 3/04 |
| EP | 2550891 | A1 * | 1/2013 | A45C 13/007 |
| WO | WO-9516616 | A1 * | 6/1995 | B65D 43/161 |
| WO | WO-2011066140 | A1 * | 6/2011 | A45C 11/20 |

OTHER PUBLICATIONS

Clear Weahertight Totes. Product [online]. [retrieved on Jan. 28, 2022]. Retrieved from the Internet: <URL: https://www.containerstore.com/s/garage/storage-bags-boxes/clear-weathertight-totes/12d?productId=10026213>.

Ultimate Survival Technologies FlexWare Sink-Orange. Product [online]. [retrieved on Jan. 28, 2022]. Retrieved from the Internet: <https://www.amazon.ca/Ultimate-Survival-Technologies-FlexWare-Sink-Orange/dp/B01E7EJ1H2/ref=asc_df_B01E7EJ1H2/?tag=googleshopc0c-20&linkCode=df0&hvadid=293036632477&hvpos=1o2&hvnetw=g&hvrand=6443196037584528 49&hvpone=&hvptwo=&hvqmt=&hvdev=c&hvdvcmdl=&hvlocint=&hvlocphy=9001587&hvtargid=pla-.

New Food Grade Blue Collapsible Silicone Caravan Camping Wash Tub Sink w/ Drain. Product [online]. [retrieved on Jan. 28, 2022]. Retrieved from the Internet: <https://www.autobox.com.au/new-food-grade-collapsible-silicone-caravan>.

Canadian Examiner's Requisition dated Sep. 20, 2023 for the corresponding Canadian application 3,160,059.

Canadian Examiner's Requisition dated May 3, 2024 for the corresponding Canadian application 3,160,059.

International Search Report and Written Opinion for the PCT application dated Mar. 23, 2021.

Supplementary European Search Report & Search Opinion for the European application dated Jan. 12, 2023.

* cited by examiner

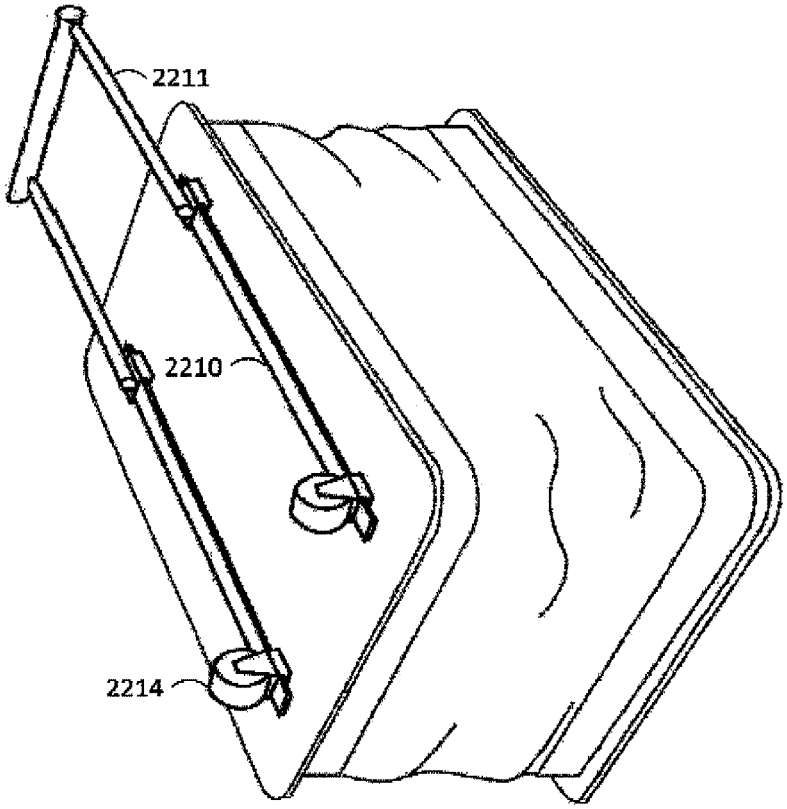
FIG. 22A
FIG. 22B
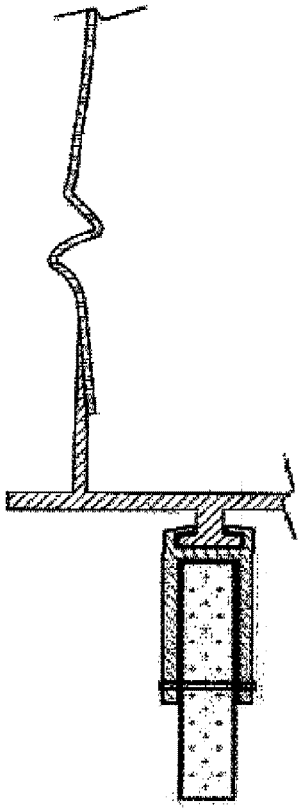

PORTABLE COLLAPSIBLE MODULAR AND WATERPROOF STORAGE AND TRANSPORTATION SYSTEM

FIELD

The present disclosure relates generally to modular container systems for transport and storage. More particularly, to a customizable system for which the user can selectively configure lids, bases, wheels, straps, handles, and other accessories. The containers can also be expanded and collapsed for efficient storage and transportation.

BACKGROUND

There is a range of containers available for transporting and storing cargo or goods. Some containers include collapsible rigid panels, such as US952762691 to Coronado. Others include an expandable section such as in U.S. Pat. No. 7,021,437B2 to Ghiassi, including expandable accordion side walls such as in U.S. Pat. No. 5,913,448A to Mann at al., or bellows as in US20060180614A1 to Barron et al. Some containers are comprised of a mix of hard and soft materials and are waterproof, with a sealing lid, such as the OtterBox® drybag. Some containers are sized to permit stacking of multiple containers of the same type.

Disadvantages include that rigid containers are inefficient for storage as they stay the same size no matter the volume of the contents, are difficult to fit in spaces that are small or awkwardly shaped, and cannot be configured for different purposes, as the handles and other components are integral and cannot be selectively customized. Some bags are soft and collapse so are difficult or impossible to efficiently load and stack. Seals such as zippers which are commonly used, do not withstand rough or outdoor use well and often break far earlier than the wear limit of the container is reached, and are not air or watertight. Other forms of watertight seal such as the roll top system are cumbersome and slow to employ.

Therefore, there is a need for bags, totes, and containers which compress to the size of the contents, have an air and watertight seal which is easy and quick to use yet is reliable, which also stand open for ease of loading and unloading, and are of a modular design for ease of stacking and efficient storage. There is also a need for a container system that interchangeably receives a range of accessories.

BRIEF DESCRIPTION OF THE DRAWING

The above, and other, aspects, features, and advantages of several embodiments of the present disclosure will be more apparent from the following detailed description as presented in conjunction with the following several figures of the drawings.

The apparatus and methods of the present disclosure will now be described with reference to the several accompanying figures of the drawings, as follows.

FIG. 22A is a perspective view of an exemplary inverted watertight container with a rigid rim and base and flexible wats and a rigid lid with an air and watertight seal and base mounted rails with removably mounted wheels and extendible handle in a closed, extended position, in accordance with one aspect of the present disclosure.

FIG. 22B is a detailed discontinuous cross-sectional view of an exemplary inverted watertight container with a rigid rim and base and flexible was and a rigid lid with an air and watertight seal and base mounted rails with a removably mounted wheel in a closed, extended position, in accordance with one aspect of the present disclosure.

Figure 1:
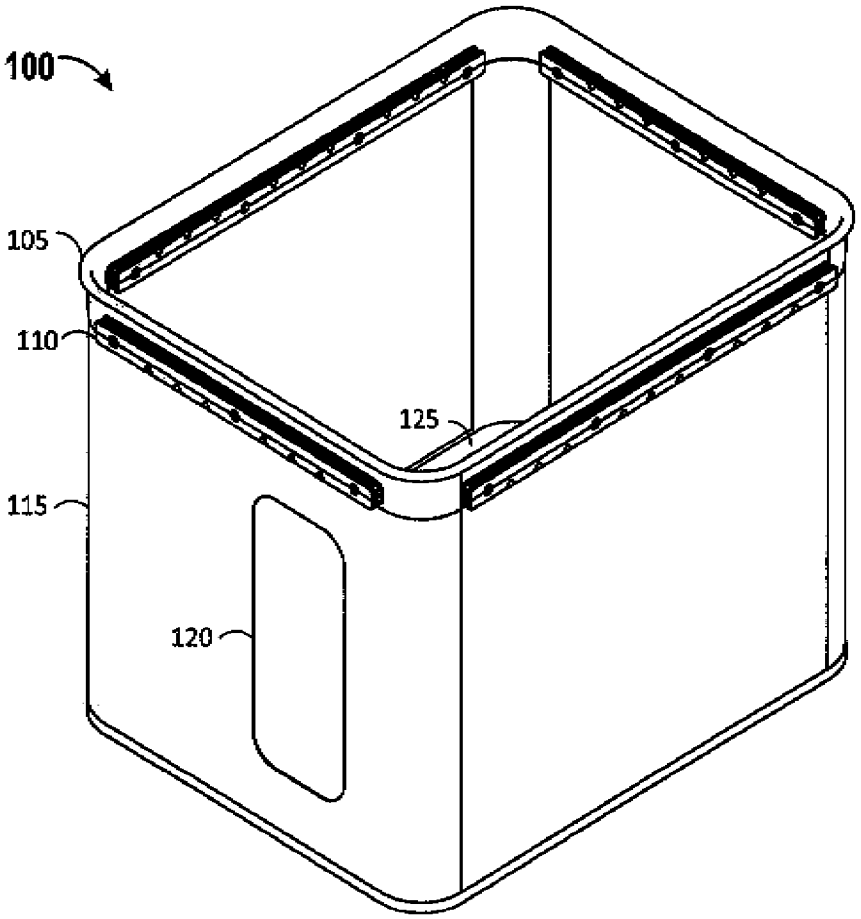
FIG. 1 is a perspective view of an exemplary modular and waterproof storage container and rim in accordance with one aspect of the present disclosure.

Corresponding reference characters indicate corresponding components throughout the several figures of the Drawing. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but we-understood, elements that are useful or necessary in commercially feasible embodiment are often not depicted to facilitate a less obstructed view of these various embodiments of the present disclosure.

DETAILED DESCRIPTION

The following description is not to be taken in a limiting sense but is made merely far the purpose of describing the general principles of exemplary embodiments. The scope of the disclosure should be determined with reference to the Claims. Reference throughout this specification to "one embodiment," "one aspect," or similar language denotes that a particular feature, structure, or characteristic, described in connection with the embodiment, is included in at least one embodiment of the present disclosure. Thus, appearances of the phrases "in one embodiment," "in one aspect," and similar language throughout this specification may, but do not necessarily, al refer to the same embodiment.

Further, the described features, structures, or characteristics of the present disclosure may be combined in any suitable manner in one or more embodiments, in the Detailed Description numerous specific details are provided for a thorough understanding of embodiments of the disclosure. One sidled in the relevant art will recognize, however, that the embodiments of the present disclosure can be practiced without one or more of the specific details, or with other methods, components, materials, and so forth, and still remain encompassed by the present disclosure. In other instances, well-known structures, materials, or operations are not shown or described in detail to avoid obscuring aspects of the present disclosure.

FIG. 1 is a perspective view of an exemplary modular and waterproof storage container 100 and rim 105 in accordance with one aspect of the present disclosure. The storage container 100 includes a rigid rim 105, rigid rails 110, flexible walls 115, a clear window 120, and a rigid insert 125 in the bottom of the container 100.

The container 100 may be part of a modular, tessellating, collapsible container system, in which the container 100 may be configured to accept a variety of modular, parts and accessories. The container 100 can offer many features to its users, including being flexible and easy-to-store, while also being versatile using various modular options for the container 100, some of which are illustrated here. The container 100 can include flexible walls 115, which enable the container 100 to expand to store many items while also able to collapse to enable efficient storage of the container 100 itself. These flexible was may be waterproof. The flexible walls 115 of the container 100 may be constructed from materials including fabric (e.g., cotton, hemp, nylon, polyester), felt (e.g., wool, synthetic fibers), fabric coated with polyurethane ("PU"), polyvinyl chloride ("PVC"), or silicon, rubber (e.g., synthetic or silicon), and/or plastic (e.g., thermoplastic polyurethane ("TPU"), polypropylene ("PP"), polyethylene ("PE")). Other suitable materials may also be chosen based on their weight, flexibility, durability, water resistance, and other characteristics.

The container 100 may be shaped to allow for easy storage of the container 100 and to allow the container 100 to be stacked above and next to other similar containers to offer an efficient packing mechanism for users. For example, the container 100 may be in a substantially rectangular shape, with six substantially rectangular or square sides, allowing for efficient storage of contained items. As illustrated, the container 100 may have rounded corners and edges and substantially planar aides at right angles from each other.

The container 100 includes a transparent window 120 in one of its sides. The container may include multiple windows, allowing a user to view what is inside the container 100 without having to open it This may be particularly useful when the container 100 is stored with a large number of other containers, such as if the containers are stacked together with each of them having one or more windows exposed, allowing a user to know which container they wish to open without having to open al the containers or rely on potentially-incorrect labels on the containers. The window 120 may be constructed from a clear flexible plastic (e.g., TPU, vinyl, PVC, PP, PP), a fabric mesh (e.g., cotton, hemp, nylon, polyester), or other suitable materials.

The container 100 includes a rigid rim 105 and rigid rails 110. These components may be constructed from plastic (e.g., nylon, PP, PE, TPU, acrylic, polymer), carbon fiber or glass fiber composite, aluminum, wood, or other suitable materials. The rigid rim 105 and rigid rails 110 may both be removable from the container 100, to allow them to be used with other containers such as containers with different wall materials, or to allow for different rims and rails to be used for different applications. The rigid rails 110 may be removably attached to the rigid rim 105, to allow the rails 110 to be interchanged and removed, as necessary. The rails 110 may be attached to the rim 105 using metallic fasteners (e.g., stainless steel, carbon steel, aluminum), snap fit or siding joints, or adhesives or welding. The rails 110 may be permanently attached to the rim 105, such as if they are welded in place.

The container 100 includes a rigid insert 125 in its bottom. This insert 125 can strengthen the container 100 and allow it to keep its shape when it is in use. The insert 125 can be made of any suitable material, including plastic (e.g., nylon, PP, PE, TPU, acrylic, polymer), carbon fiber or glass fiber composite, or foam.

The container 100 may be assembled using radio frequency welded seams, stitched, and taped seams, stitched seams, or using any other suitable assembly technique.

Figure 2:
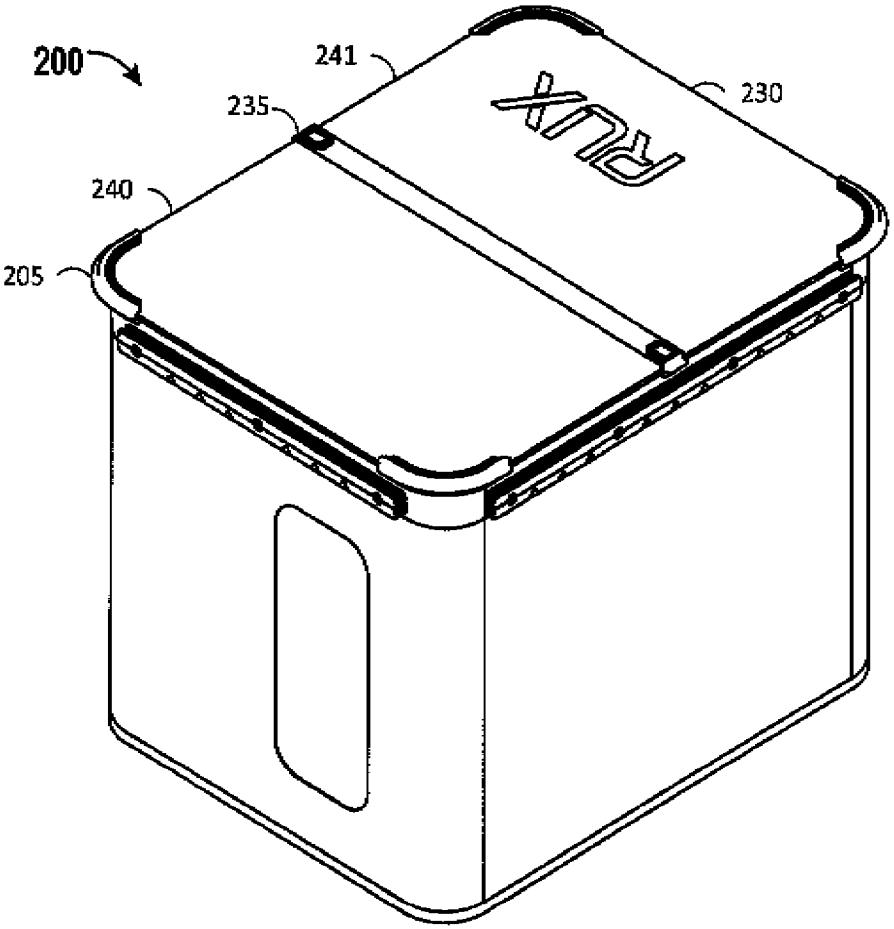
FIG. 2 is a perspective view of an exemplary modular and waterproof storage container with a closed lid in accordance with one aspect of the present disclosure.

FIG. 2 is a perspective view of an exemplary modular and waterproof storage container 200 with a closed lid 230 in accordance with one aspect of the present disclosure. The container 200 may contain features like those of container 100 in FIG. 1, including a rim 205. Here, the container 200 has a lid 230 on top of it.

As illustrated, lid 230 is made of a rigid material with a central portion 235 which remains in place while two outer portions 240, 241 and open, hinging up from the central portion 235. The lid 230 may be made from foam (e.g., ethylene-vinyl acetate ("EVA")), wood or wood composite, plastic (e.g., TPU, PP, PE, silicon), or other suitable materials. The Ed 230 may attach to the rim 205 via rigid snap fit clip, rubber or flexible thermoplastic clips, rope or webbing made of nylon or PE, straps made of flexible TPU or thermoplastic elastomers ("TPE"), shock cord or other stretch fabric, molded rubber of RPU to create a water/airtight seal, or other suitable methods.

A variety of different lids may be available for container 200. For example, different ids may be chosen based on whether they need to be airtight or watertight. Both flexible or rigid lids may potentially be offered, as well as lids without hinging openings, with a single hinging opening, or with other designs and/or functions.

Figure 3:
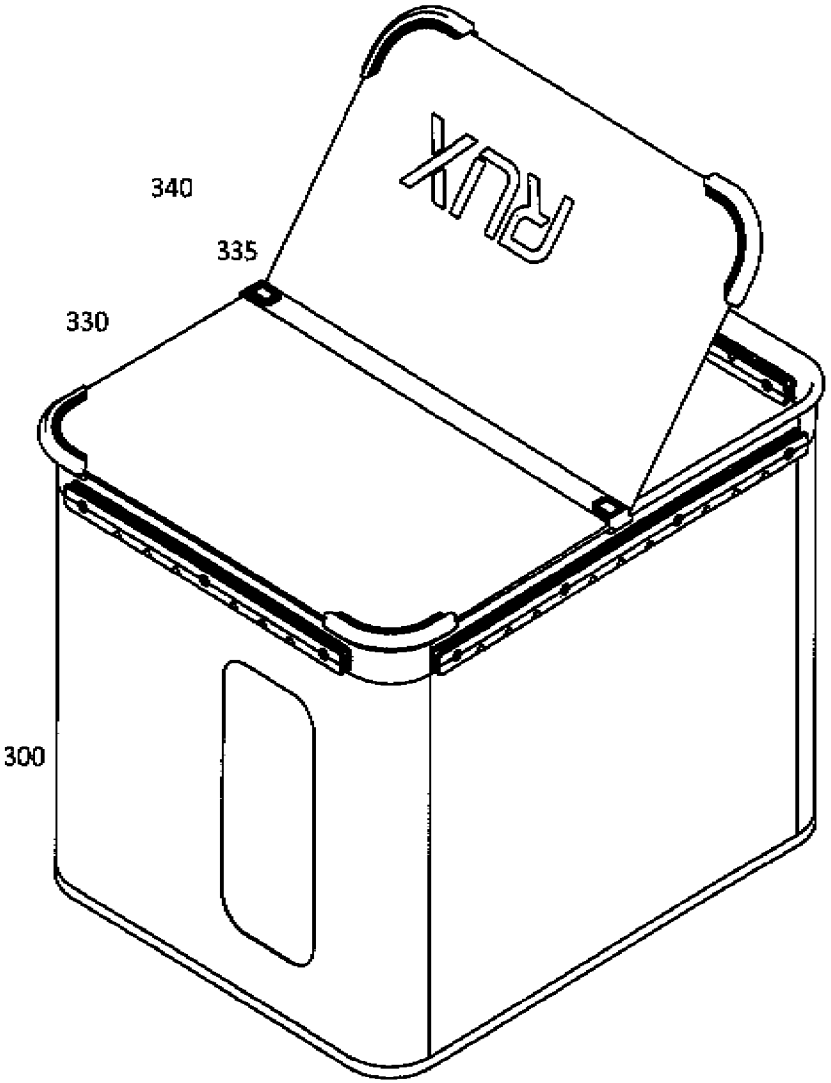
FIG. 3 is a perspective view of an exemplary modular and waterproof storage container with an open lid in accordance with one aspect of the present disclosure.

FIG. 3 is a perspective view of an exemplary modular and waterproof storage container 300 with an open lid 330 in accordance with one aspect of the present disclosure. As with the container 200 of FIG. 2, container 300 includes a lid 330. The id may be either flexible or rigid, depending on the needs of a particular application. For example, both flexible and rigid lids may be offered. Herm, the lid 330 is open on one of the two sides of its central portion 335. As illustrated, the lid 330 may open by hinging from the central portion 335, allowing a user to access the contents of the container 300 without fully removing the lid 330.

Figure 4:
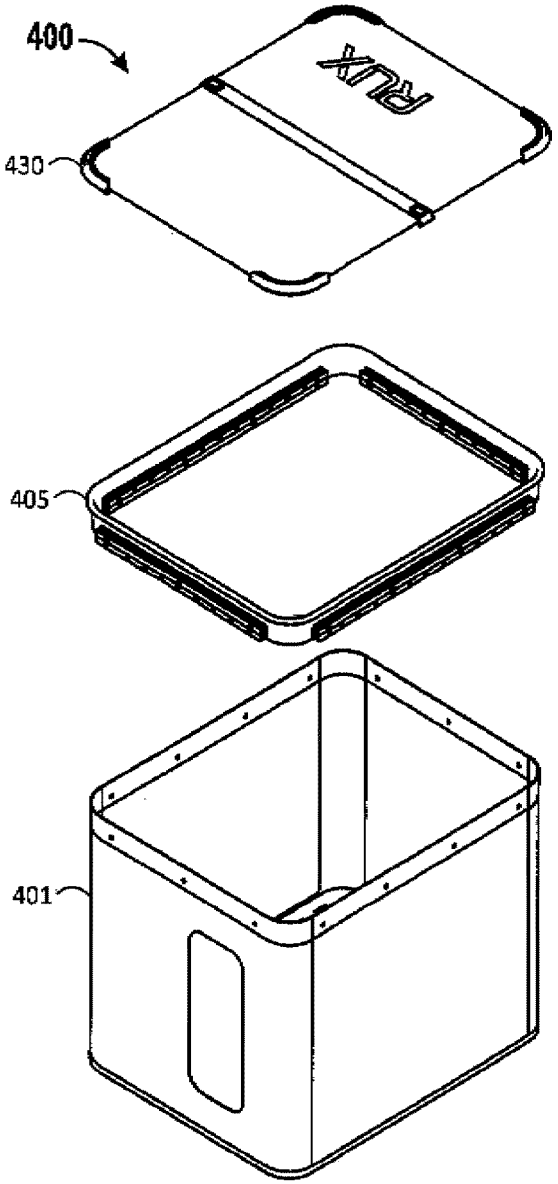
FIG. 4 is an exploded view of an exemplary modular and waterproof storage container system, rim, and lid in accordance with one aspect of the present disclosure.

FIG. 4 is a blown-up view of an exemplary modular and waterproof storage container system 400, including a container 401, rim and rails 405, and lid 430 in accordance with one aspect of the present disclosure. Each of these three components may be part of a modular system designed for the components to removably attached to one another to be used together. For example, the rim and rails 405 may removably attach to the container 401, which may allow the lid 430 to removably attach to the rim and rails 405. Different containers, rims, and lids may be selected by a user based on a particular use case of the overall system, such as selecting a lid which is appropriate to store the desired contents or for a desired trip or other purpose, or selecting a container constructed using appropriate materials for a given task.

Figure 6:
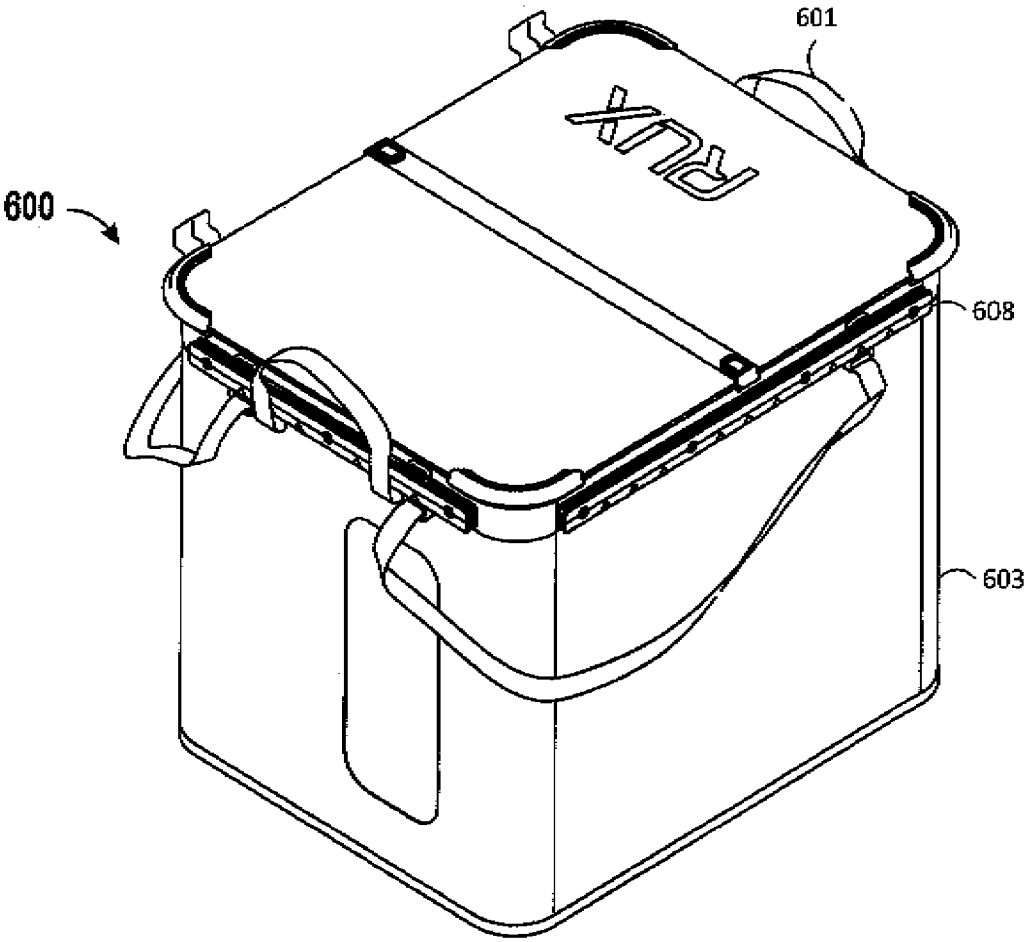
FIG. 6 is a perspective view of an exemplary modular and waterproof storage container in accordance with one aspect of the present disclosure.

FIG. 6 is a perspective view of an exemplary rigid rim 500 for a modular and waterproof storage container in accordance with one aspect of the present disclosure. As illustrated, the rim 500 may contain straight pieces 501 and corner pieces 502, which may interlock together to form a complete rim. Specifically, the rim 500 may include four corner pieces and four straight pieces, with two different lengths of straight pieces for a rectangular container. The rim 500 may be sized and shaped appropriately to fit onto a container, such as container 100. The pieces of the rim 500 may be connected to one another using metallic fasteners, such as stainless steel, carbon steel, or aluminum. The rim 500 may also be assembled using snap fit or sliding joints, or adhesives or welding, or other assembly mechanisms. The rim 500 may help provide structure to a contain that it is attached to as well as providing a versatile platform for the attachment of rails and other components.

FIG. 6 is a perspective view of an exemplary modular and waterproof storage container system 600 in accordance with one aspect of the present disclosure. As shown, this container has a rail 608 attached to an upper portion of the container 603 and includes one or more straps 601 connected to the rail 608. These straps 601 are one option for additional equipment which can attach to the versatile rail system 608 and which can extend the uses of the container system 600 past those of other conventional devices.

Figure 7:
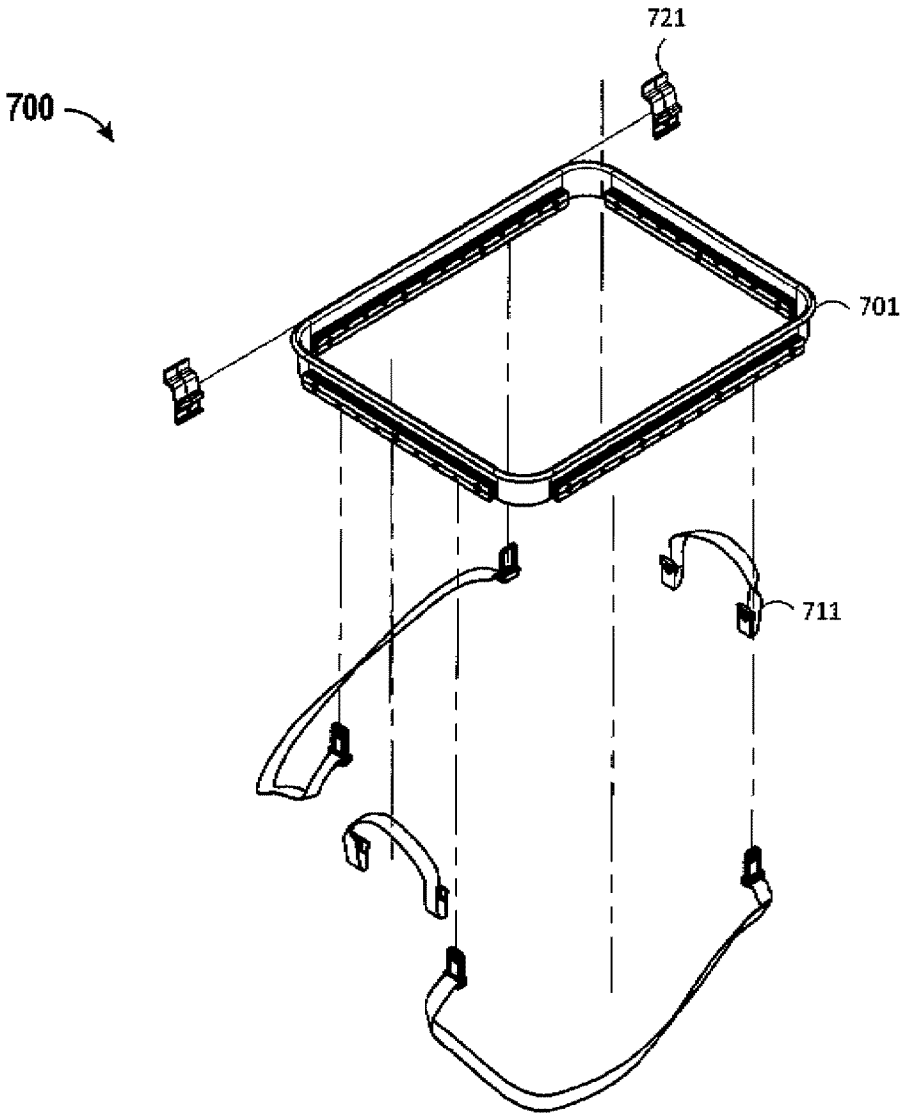
FIG. 7 is a perspective view of an exemplary rim, rails, and modular accessories for a modular and waterproof storage container in accordance with one aspect of the present disclosure.

FIG. 7 is a perspective view of an exemplary rim and rails 701, and modular accessories for a modular and waterproof storage container system 700 in accordance with one aspect of the present disclosure. The rim and rails 701 can be equipped to receive a wide variety of modular attachments, including straps 711 and wall mounts 721. The modular system 700 can be used with a wide variety of modular attachments, including handles, backpack/shoulder/tote straps, slat wag mounts that allow the box to be mounted to a wall or in, e.g., the bed of a truck, a male quick release button, or a stopper. Each of these components may be constructed using appropriate materials, such as rope or webbing, plastic, and various metal.

Figure 8:
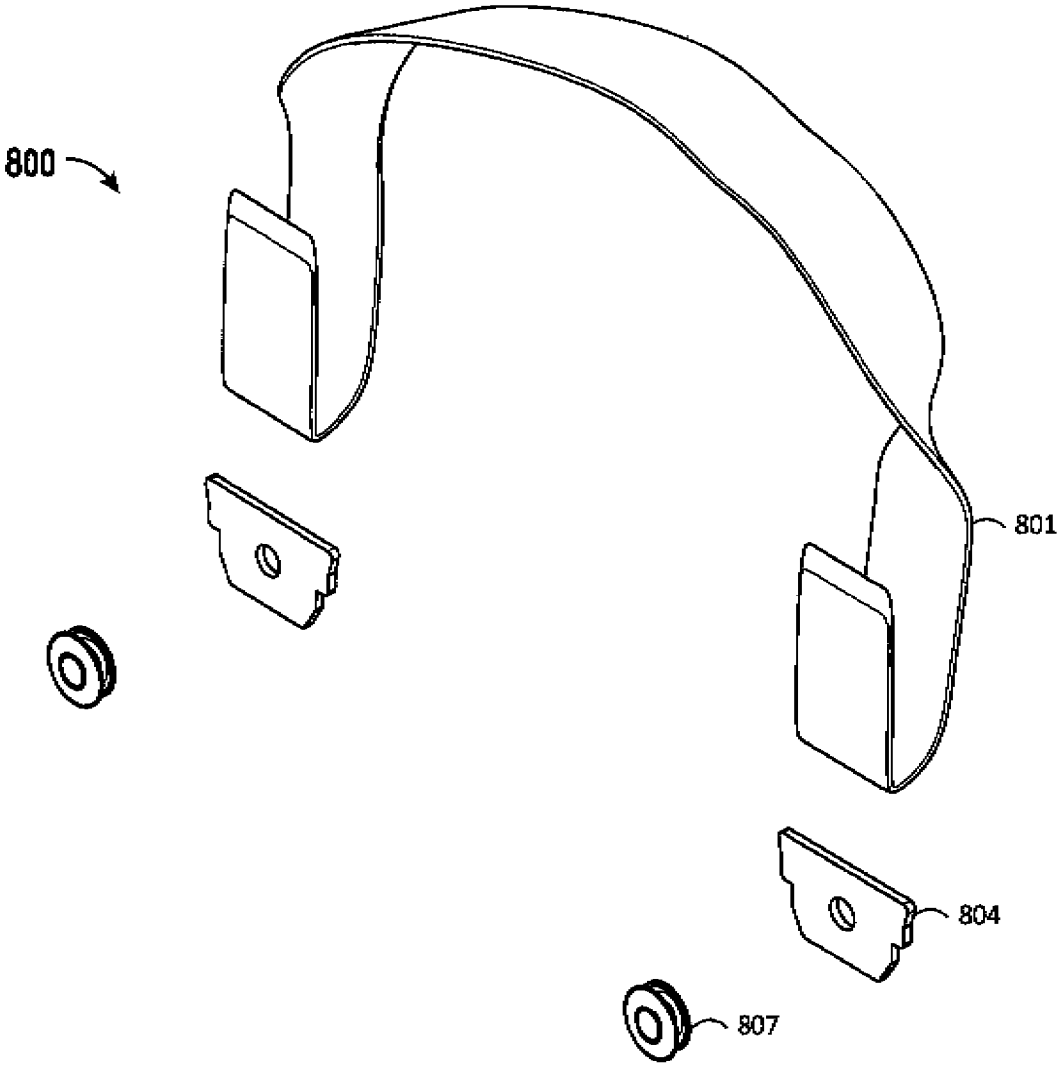
FIG. 8 is a perspective view of an exemplary handle assembly for a modular and waterproof storage container in accordance with one aspect of the present disclosure.

FIG. 8 is a perspective view of an exemplary handle assembly 800 for a modular and waterproof storage container in accordance with one aspect of the present disclosure. The handle assembly 800 includes a stopper 804, a handle 801, and a grommet 807. The handle 801 may be either flexible or rigid, depending on the needs of a particular project. For example, a rigid handle 801 may be made from plastic while a flexible handle may be made from rope or webbing made of nylon or polyethylene. The stopper and grommet may be used to removably attach the handle 801 to a rim and rail, such as the rim and rail in FIG. 7 or in one of the other exemplary illustrations contained herein.

Figure 9:
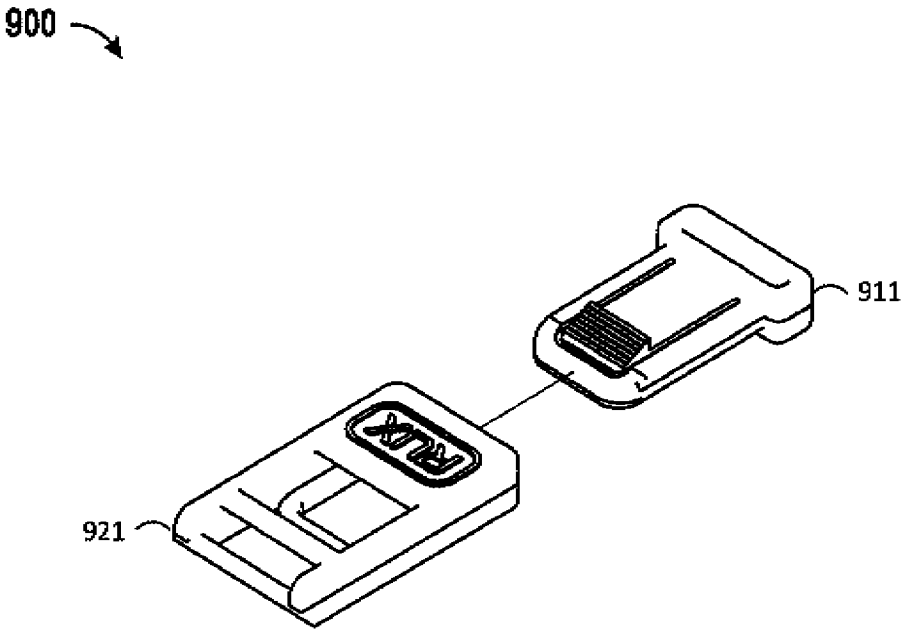
FIG. 9 is a view of an exemplary quick release buckle assembly for a modular and waterproof storage container in accordance with one aspect of the present disclosure.

FIG. 9 is a view 900 of an exemplary quick release buckle assembly for a modular and waterproof storage container in accordance with one aspect of the present disclosure. For example, the quick release buckle assembly may include a male quick release buckle 911 and a female quick release buckle 921. These two buckles may be used to removable attach modular components to a modular, collapsible storage container. For example, one of the buckles may be removably connected to a rail system attached to the storage contain while the other buckle may be attached to a removable component such as handles or backpack/shoulder/tote straps. The use of these buckles may allow for rapid removal of one modular attachment and connection of another modular attachment.

Figure 10:
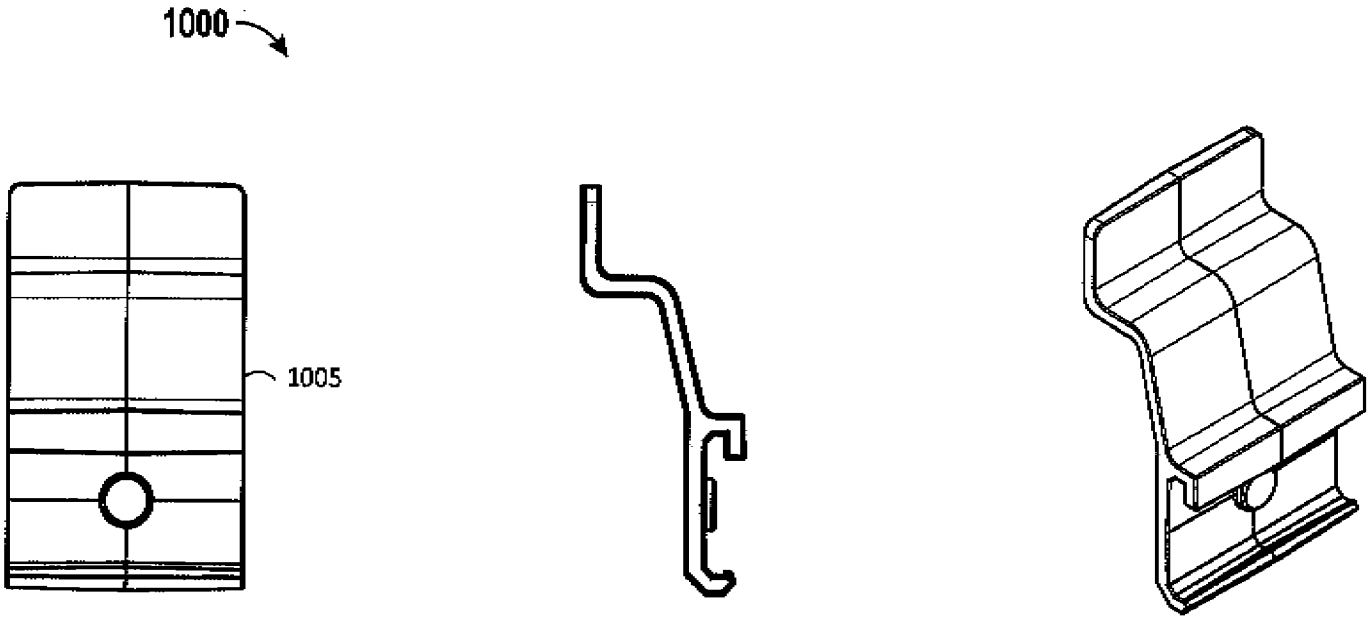
FIG. 10 is a view of an exemplary slat wall attachment for a modular and waterproof storage container in accordance with one aspect of the present disclosure.

FIG. 10 is a view 1000 of an exemplary slat wall attachment 1005 for a modular and waterproof storage container in accordance with one aspect of the present disclosure. The slat wall attachment 1005 may be configured to attach to the rail system of the modular, collapsible storage container. The slat wag attachment 1005 can allow the container to removably attach to a compatible system installed on a wag, in the back of a vehicle, or in any other location. This may allow the modular, collapsible storage container to removably hang on a wall, as desired by a user.

Figure 5:
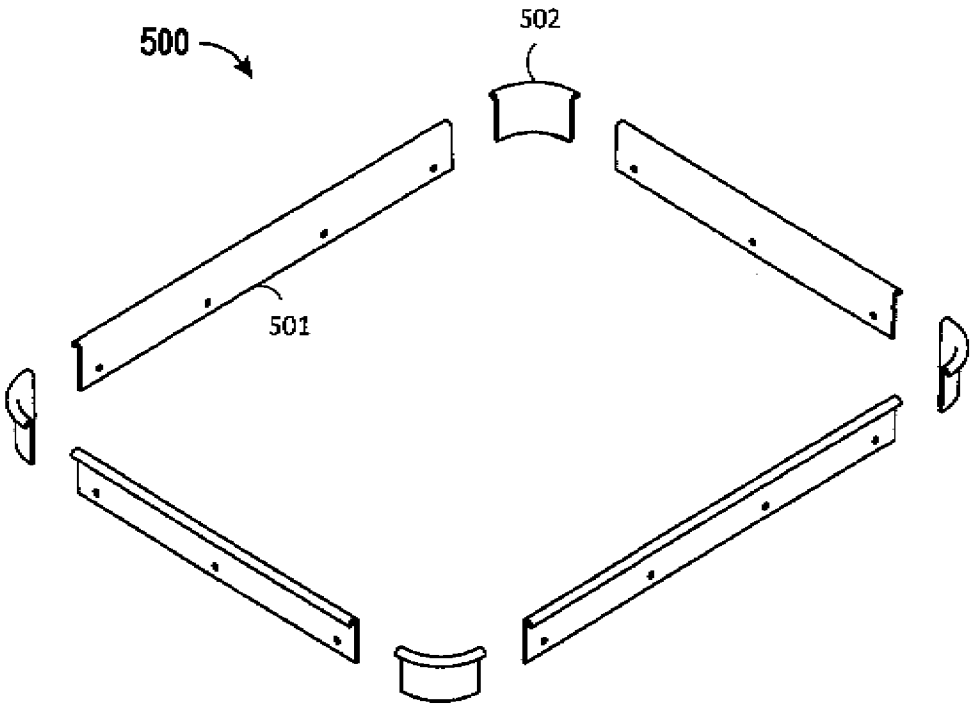
FIG. 5 is a perspective view of an unassembled exemplary rigid rim for a modular and waterproof storage container in accordance with one aspect of the present disclosure.
Figure 11:
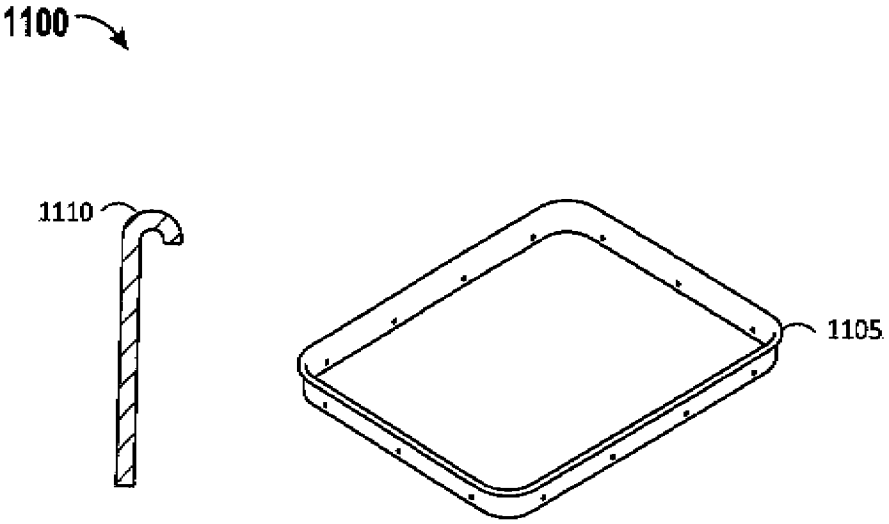
FIG. 11 is a view of an exemplary one-piece rim for a modular and waterproof storage container in accordance with one aspect of the present disclosure.

FIG. 11 is two views 1110, 1105 of an exemplary one-piece rim 1100 for a modular and waterproof storage container in accordance with one aspect of the present disclosure. These views illustrate a possible shape for the rim 1100 of the modular, collapsible storage container. The rim may feature a hooked shape, as shown in profile view 1110, for attaching a lid and for attaching other accessories. The rim may be one-piece or may be constructed using multiple pieces which removably attach from one another, such as those illustrated in FIG. 5.

Figure 12:
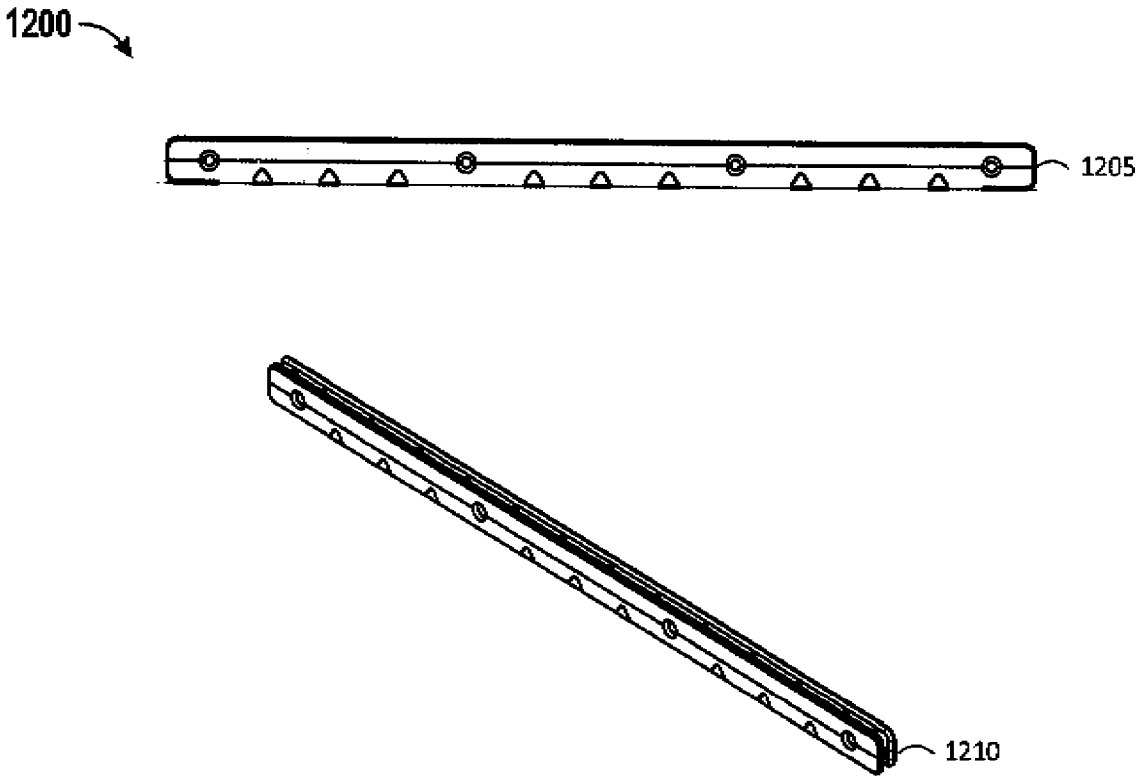
FIG. 12 is a view of an exemplary rail system for a modular and waterproof storage container in accordance with one aspect of the present disclosure.

FIG. 12 is two views 1205, 1210 of an exemplary rail system 1200 for a modular and waterproof storage container in accordance with one aspect of the present disclosure. The rail system 1200 includes a unique profile and boss design for attaching multiple different attachments depending on required applications. The rail system 1200 features molded designs to show users where to place attachments. The rail system 1200 may be made of plastic (e.g., nylon, PP, PE, TPU, Acrylic, polymer), carbon or glass fiber composite, aluminum, wood or wood composite, or other suitable materials.

Figure 13B:
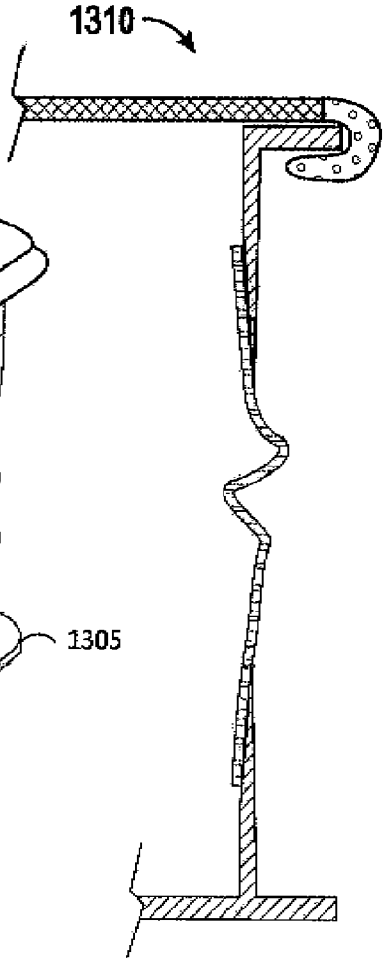
FIG. 13B is a detailed cross-sectional view of an exemplary interface between the flexible walls and rigid lid and base a rigid rim of a container with an air and watertight seal, in a closed, extended position, in accordance with one aspect of the present disclosure.
Figure 13A:
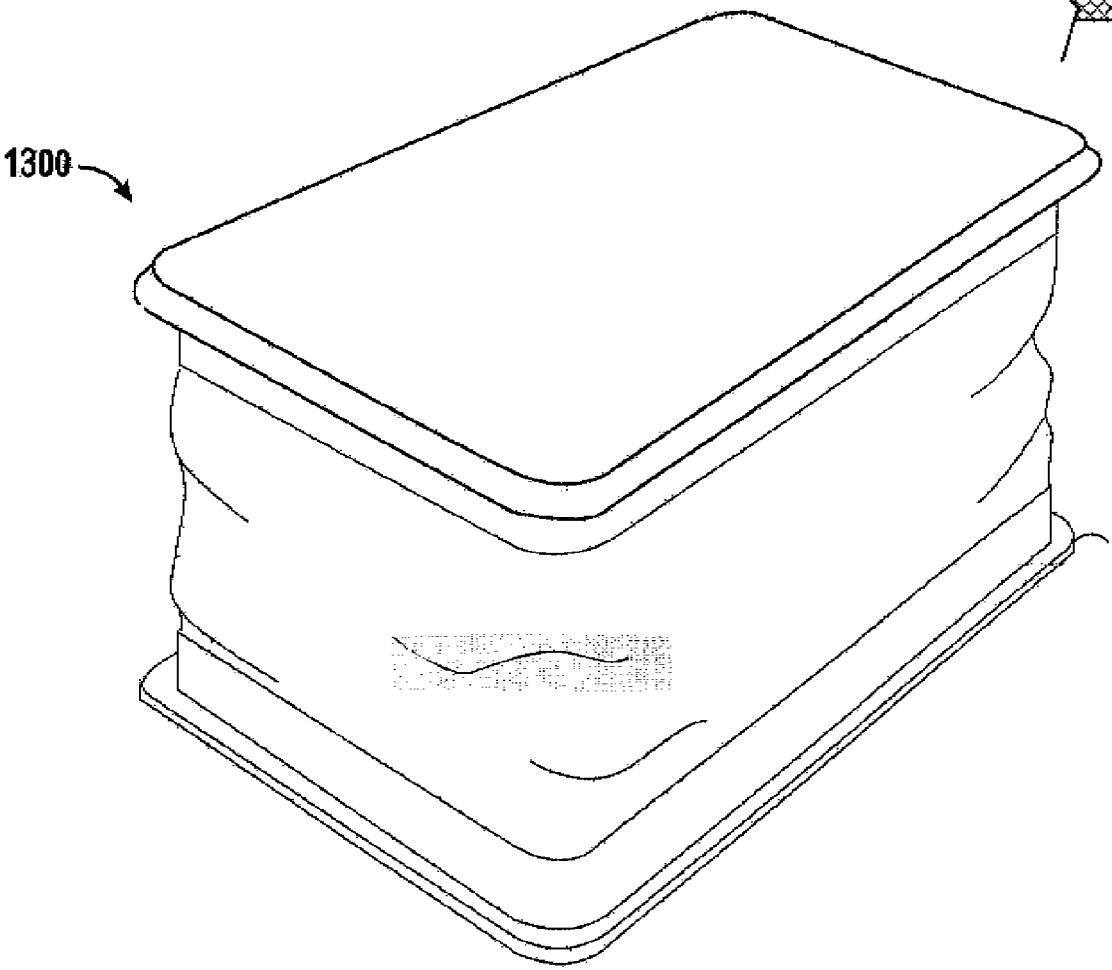
FIG. 13A is a perspective view of an exemplary vacuum container with a rigid rim and base and flexible walls and a rigid lid with an air and watertight seal in a closed, extended position, in accordance with one aspect of the present disclosure.

FIG. 13A is a perspective view 1300 of an exemplary vacuum container 1305 with a rigid rim and base and flexible wens and a rigid lid with an air and watertight seal in a closed, extended position. In accordance with one aspect of the present disclosure. The container can include a rigid rim and flexible was with a flexible lid with an air and watertight semi and a two-way valve. This can maintain pressure within the container. The flexible lid may snap onto the rigid rim of the container, as illustrated in the cross-view 1310 in FIG. 13B. The container can include flexible walls, allowing the container to collapse to a smaller size for storage.

Figure 14:
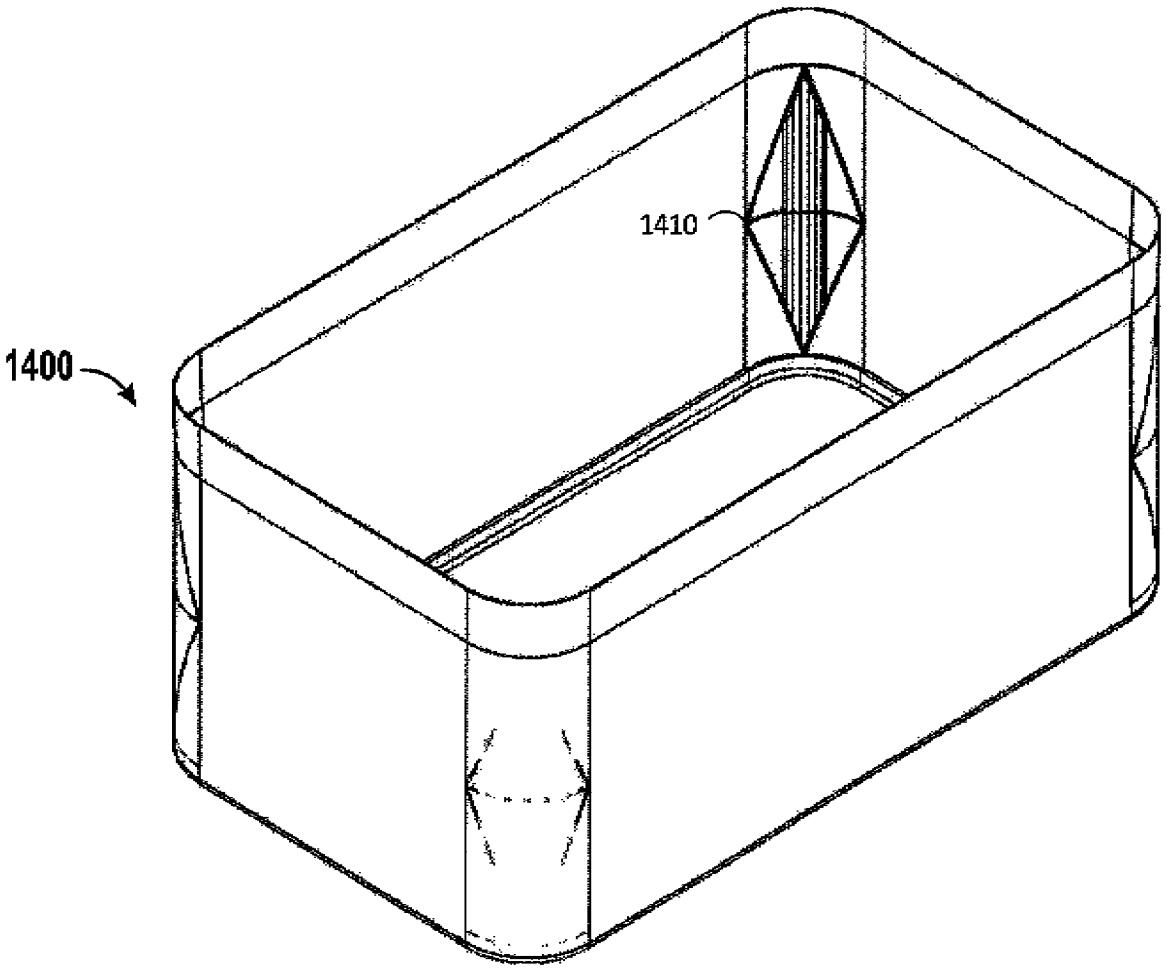
FIG. 14 is a view of an exemplary modular and waterproof storage container with collapsing supports in accordance with one aspect of the present disclosure.
Figure 15:
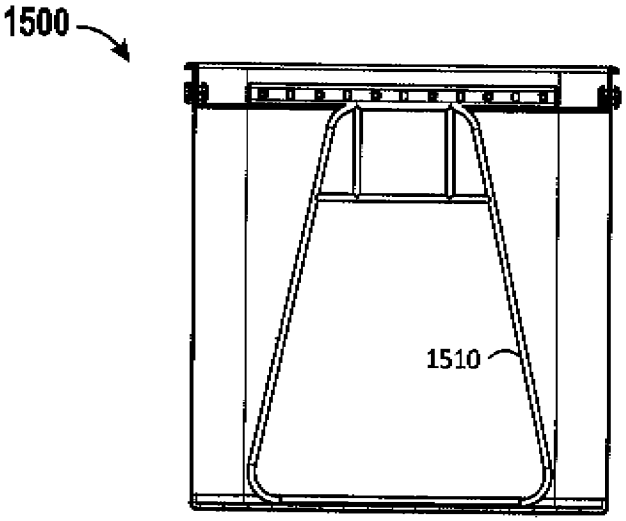
FIG. 15 is a view of a folding stand on the inside of the storage container according to one aspect of the present disclosure.
Figure 16B:
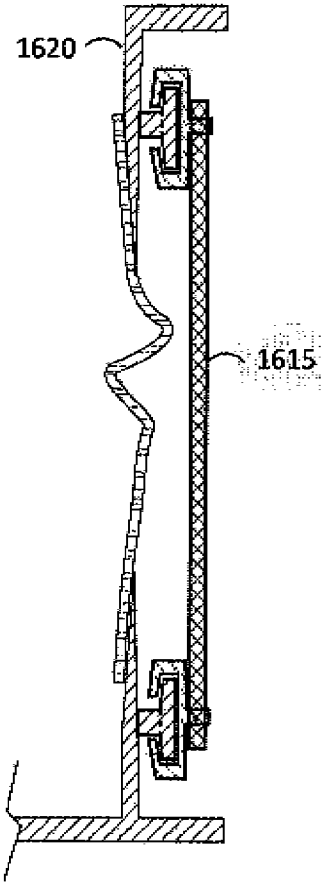
FIGS. 16A and 16B are views of an exemplary modular and waterproof storage container with folding stands in accordance with one aspect of the present disclosure.
Figure 16A:
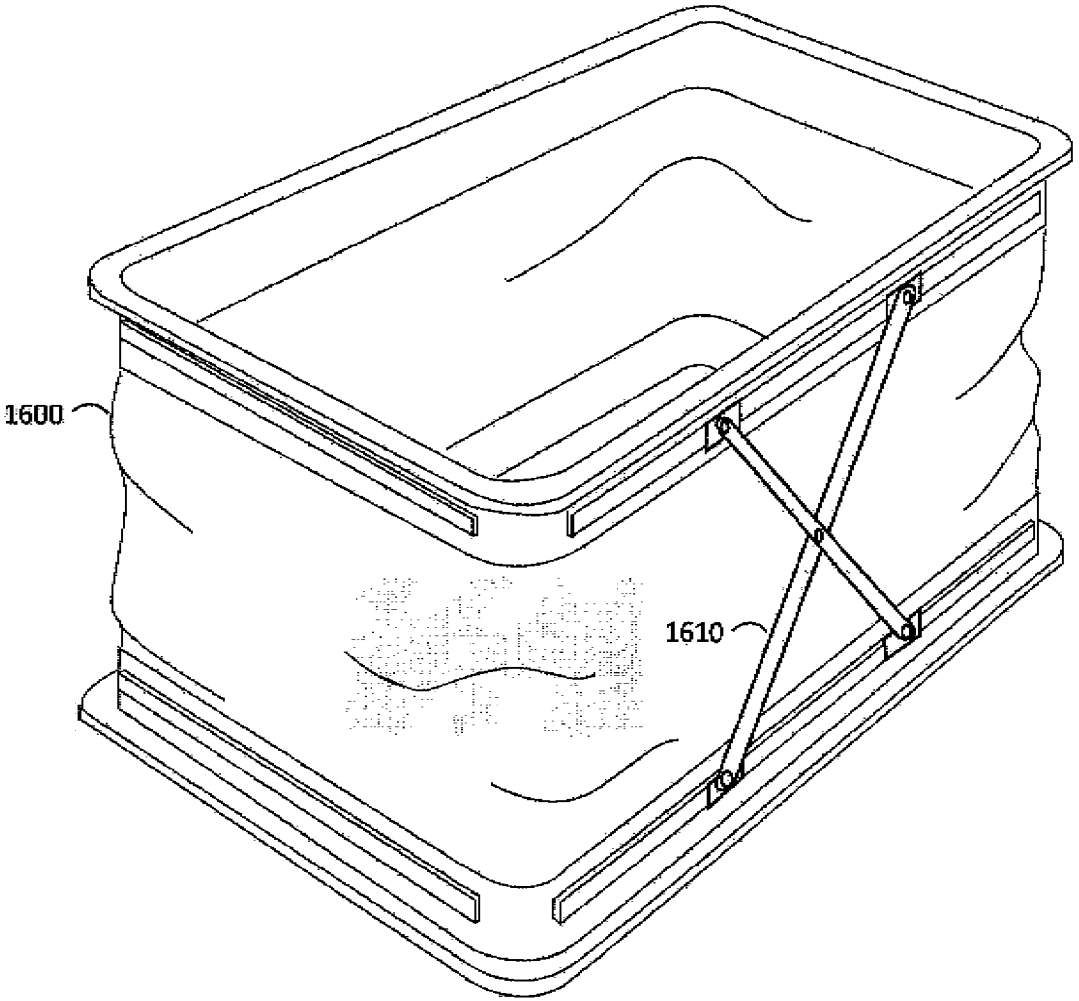
Figure 18B:
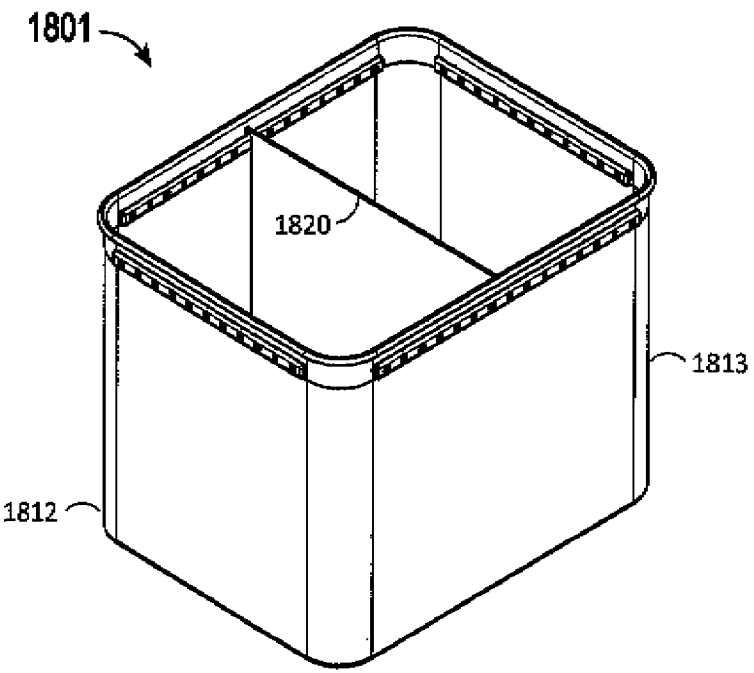
FIGS. 18A and 18B are views of an exemplary modular and waterproof storage container with a removable divider in accordance with one aspect of the present disclosure.
Figure 18A:
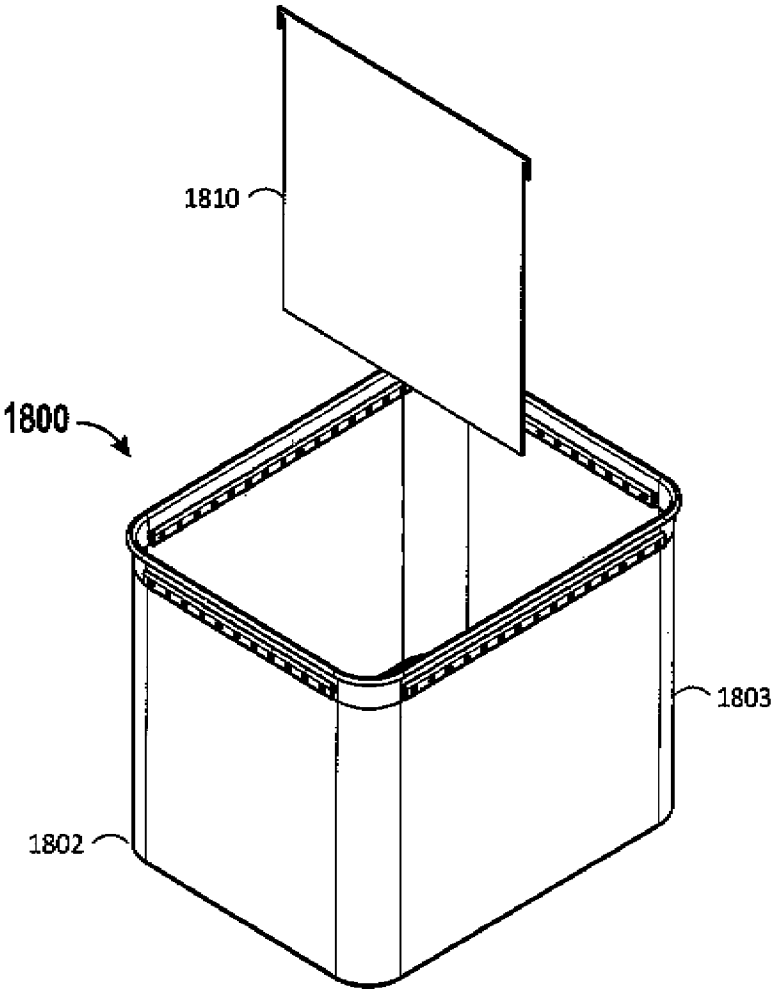

The container may also include collapsing supports 1410 which can help the container 1400 stand, as illustrated in FIG. 14. The collapsing supports 1410 used to support the container 1400 may take any number of forms. For example, a bi-stable spring may be used to allow the support 1410 to remain in either a collapsed or an extended position. Other materials may also be used for the collapsing supports 1410, such as foam, flexible plastic, high denier fabric, and other suitable materials. Another support 1510 which may help the container 1500 stand is illustrated in FIG. 16. This support 1510 may include folding stands on the inside of the container 1500 which can be removably attached to provide structure to the container 1500. The removable support 1510 may be made from plastic, carbon or glass fiber, aluminum, steel, or other suitable materials. FIGS. 18A and 168 illustrate another possible support for the flexible container. Here, the container 1600 can have braces or cross supports 1610 on the outside of the container 1600 which can be attached to provide structure to the container 1600. These braces 1610 may, in one aspect, be removable, in light with the modular nature of this flexible container 1600. These cross supports 1610 may be mounted to the side of the container 1600 and may allow the container to remain either compressed or to remain extended. FIG. 168 illustrates a cross-section view of these supports 1615 on the container 1620.

Figure 17:
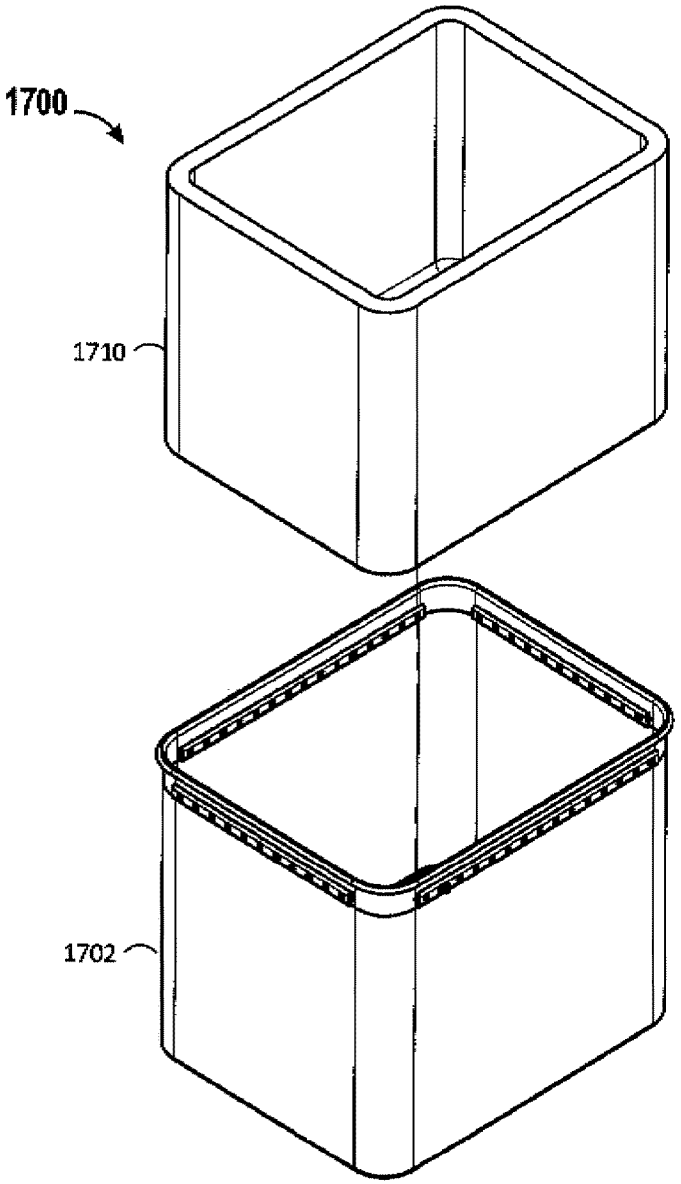
FIG. 17 is a view of an exemplary modular and waterproof storage container with an insulated insert in accordance with one aspect of the present disclosure.

FIG. 17 is a view 1700 of an exemplary modular and waterproof storage container 1702 with an insulated insert 1710 in accordance with one aspect of the present disclosure. The insulated insert 1710 may be intended to thermally insulate the contents of the container 1702 from external temperatures, allowing the contents to remain either hot or cold. This may allow the container 1702 to function as a cooler, in addition to its other features. The insulated insert 1710 can be made of foam, such as a rigid closed-cell foam insulation, can be foam insulation, or may be constructed using a flexible foil. The insulated insert 1710 may be sized appropriately to fit snugly inside the container 1702.

FIGS. 18A and 180 are views 1800, 1801 of an exemplary modular and waterproof storage container 1802, 1812 with a removable divider 1810, 1820 in accordance with one aspect of the present disclosure. This divider 1810, 1820 can serve to separate the container and can also provide support to the flexible walls 1803, 1813 acting as another way of allowing the container 1802, 1812 to keep its shape. The divider 1810, 1820 can be constructed from foam, felt, plastic with a fabric covering, or other types of plastic.

Figure 19:
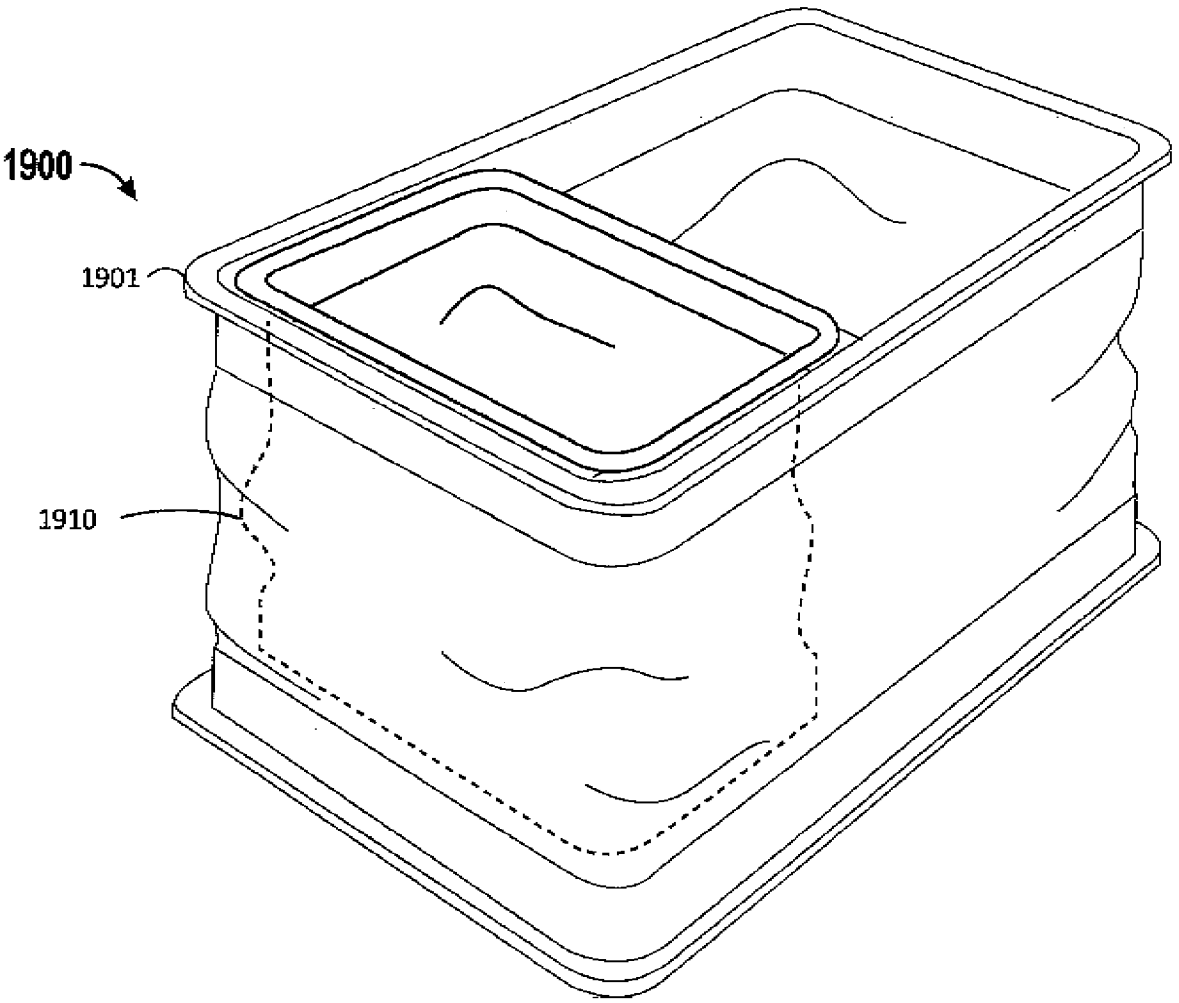
FIG. 19 is a perspective view of an exemplary container with a rigid rim and base and flexible walls and a rigid lid with a sub-compartment insert having a rigid rim and flexible bag, in an open, extended position, in accordance with one aspect of the present disclosure.

FIG. 19 is a perspective view 1900 of an exemplary container 1901 with a sub-compartment 1910 insert having a rigid rim and flexible bag, in an open, extended position, in accordance with one aspect of the present disclosure. The sub-compartment 1910 can be a smaller version of the exterior container 1901, including flexible walls and a waterproof nature, but can be shaped in different sizes and be sized to fit inside the larger container 1901. Different sizes of internal begs can be configured to fit inside the main container 1901.

Figure 20:
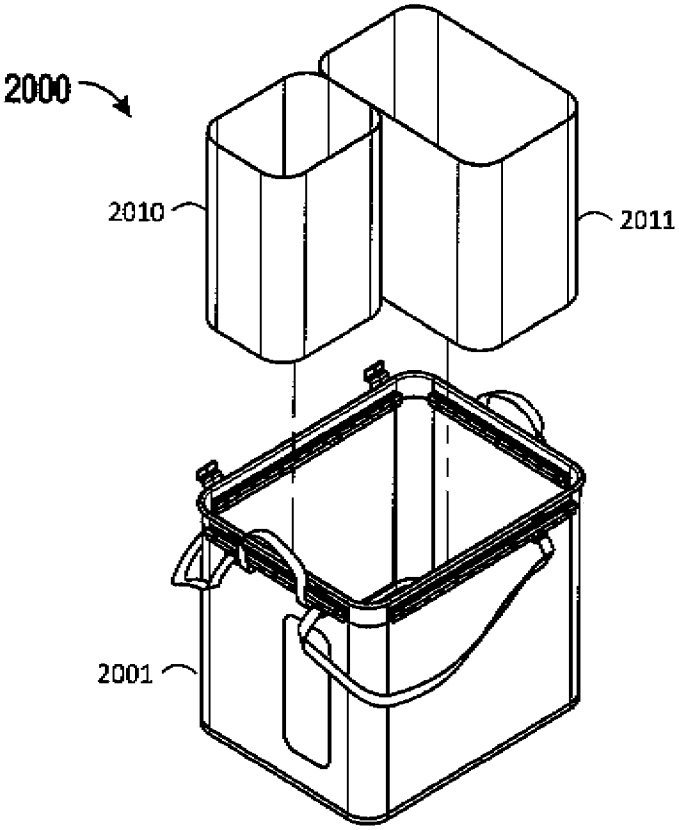
FIG. 20 is a view of an exemplary modular and waterproof storage container with two removable internal containers in accordance with one aspect of the present disclosure.

FIG. 20 is a view 2000 of an exemplary modular and waterproof storage container 2001 with two removable internal containers 2010, 2011 in accordance with one aspect of the present disclosure. Here, two different internal containers 2010, 2011 may be sized to be placed inside the larger container 2001. Various sizes of internal containers 2010, 2011 may be available. These internal containers may be constructed in a manner like the exterior container 2001. The internal containers may be sized to fit inside the exterior container 2001, and may be in sizes designed to also work with one another, such as containers which take up one-half or one-quarter of the full size of the exterior container 2001, for example.

Figure 21C:
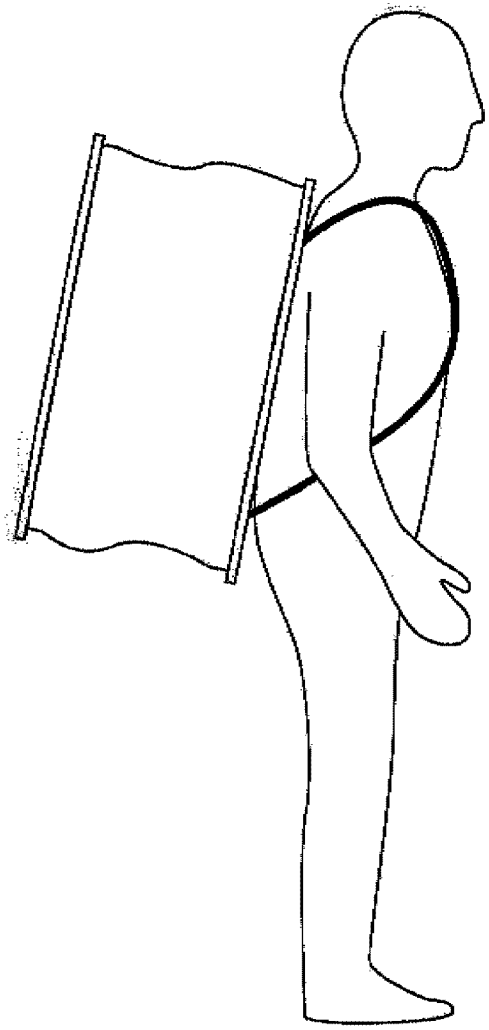
FIG. 21C is a side elevation view of a user carrying an exemplary vacuum container with a rigid rim and base and flexible walls and a rigid lid with an air and watertight seal, two-way valve and a lid top rail and removably mounted carry straps in a closed, extended position, in accordance with one aspect of the present disclosure.
Figure 21B:
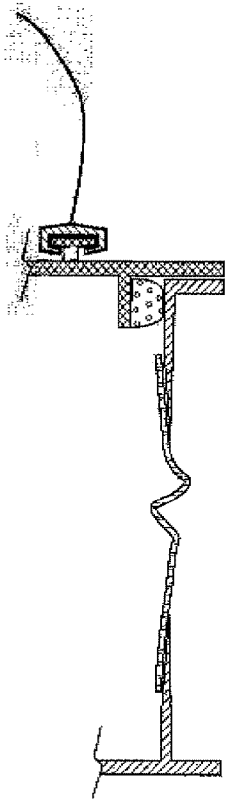
FIG. 21B is a detailed cross-sectional view of an exemplary vacuum container with a rigid rim and base and flexible walls and a rigid lid with an air and watertight seal and a two-way valve and a lid top rail and removably mounted carry straps in a closed, extended position, in accordance with one aspect of the present disclosure.
Figure 21A:
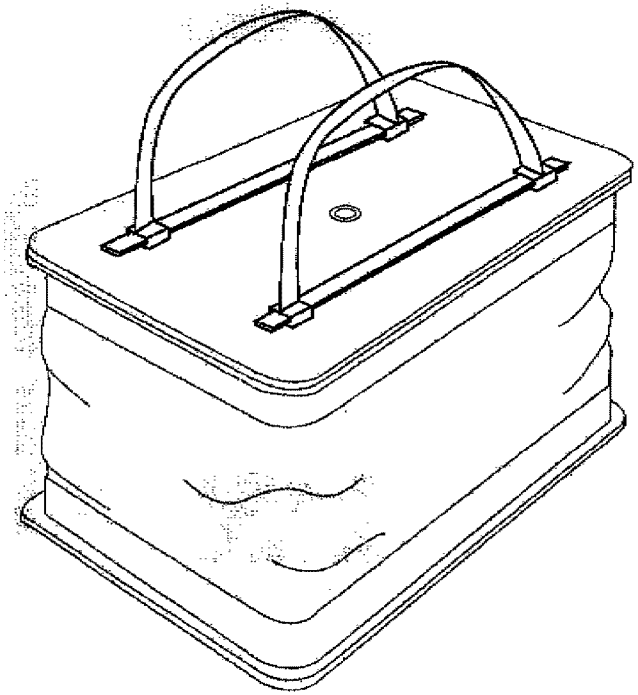
FIG. 21A is a perspective view of an exemplary vacuum container with a rigid rim and base and flexible walls and a rigid lid with an air and watertight seal and a two-way valve and a lid top rail and removably mounted carry straps in a closed, extended position, in accordance with one aspect of the present disclosure.

FIG. 21A is a perspective view of an exemplary vacuum container with a rigid rim and base and flexible walls and a rigid lid with an air and watertight seal and a two-way valve and a lid top rail and removably mounted carry straps in a closed, extended position, in accordance with one aspect of the present disclosure. FIG. 21B is a detailed cross-sectional view of an exemplary vacuum container with a rigid rim and base and flexible walls and a rigid lid with an air and watertight seal and a two-way valve and a lid top rail and removably mounted carry straps in a closed, extended position, in accordance with one aspect of the present disclosure. FIG. 21C is a side elevation view of a user carrying an exemplary vacuum container with a rigid rim and base and flexible walls and a rigid lid with an air and watertight seal, two-way valve and a lid top rail and removably mounted carry straps in a closed, extended position, in accordance with one aspect of the present disclosure. These three figures illustrate a lid which has attachment points for handles and other potential modular accessories. Here, backpack straps have been included on the lid, allowing the container itself to be carried by a user on their back, allowing for increased portability and for additional uses of the modular container system.

FIG. 22A is a perspective view of an exemplary inverted watertight container with a rigid rim and base and flexible was and a rigid lid with an air and watertight seal and base mounted rails 2210 with removably mounted wheels 2214 and extendible handle 2211 in a closed, extended position, in accordance with one aspect of the present disclosure. The rigid bottom of the container allows for the placement of rails where handles and other accessories may be attached. In this illustration, wheels 2214 and a handle 2211 are also removably attached, so the container may be rolled along the ground, as in a "drag bag" piece of luggage.

FIG. 22B is a detailed discontinuous cross-sectional view of an exemplary inverted watertight container with a rigid rim and base and flexible walls and a rigid lid with an air and watertight seal and base mounted rails with a removably mounted wheel in a closed, extended position, in accordance with one aspect of the present disclosure.

Figure 23C:
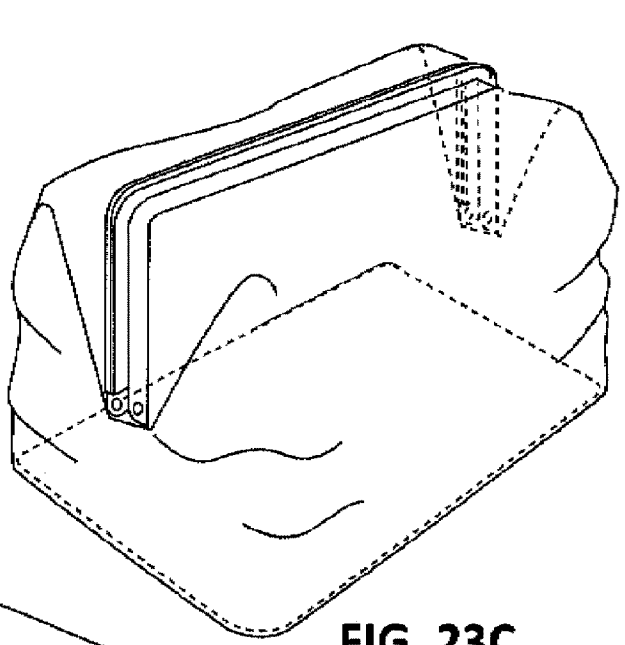
FIG. 23C is a perspective view of a vacuum container with a rigid rim and base and flexible was with a longitudinally hinged closed doctor bag rim in extended position, where the rim has closed along its longitudinal axis and sealed, without need for a lid.
Figure 23B:
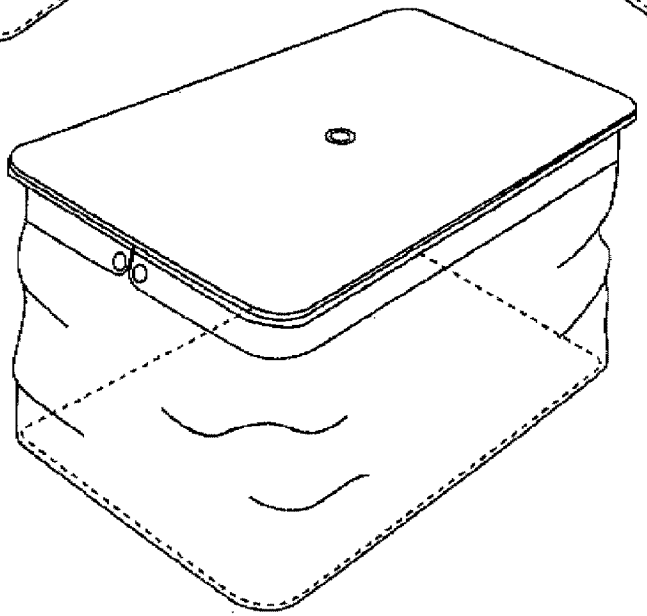
FIG. 23B is a perspective view of an exemplary vacuum container with a rigid rim and flexible base and walls and a rigid 11*d* with an air and watertight seal and a two-way valve with a longitudinally hinged doctor bag rim.
Figure 23A:
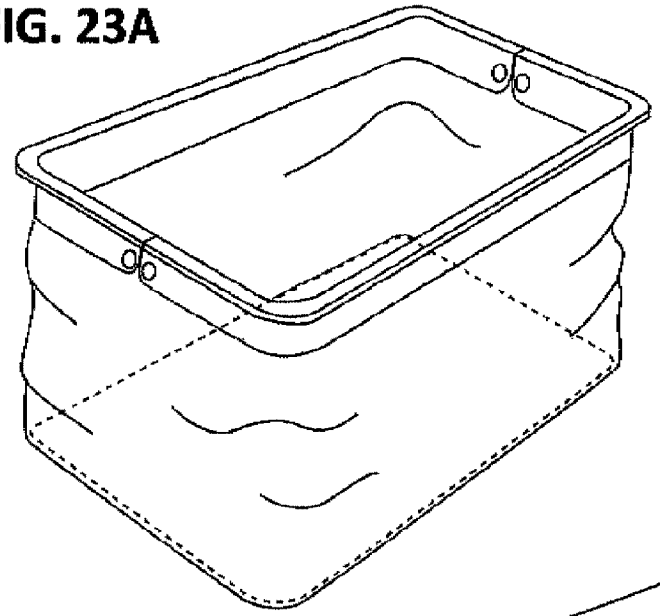
FIG. 23A is a perspective view of an exemplary vacuum container with a rigid rim and base and flexible web with a longitudinally hinged doctor bag rim in an open, extended position, in accordance with one aspect of the present disclosure.

FIG. 23A is a perspective view of an exemplary vacuum container with a rigid rim and base and flexible walls with a longitudinally hinged doctor bag rim in an open, extended position, in accordance with one aspect of the present disclosure. In this illustration, the bass of the container may be a soft continuation of the walls, and the rim of the container is equivalent to the rim of the other containers described herein, allowing it to receive lids and other modular accessories of the other containers herein.

FIG. 23B is a perspective view of an exemplary vacuum container with a rigid rim and flexible base and walls and a rigid lid with an air and watertight seal and a two-way valve with a longitudinally hinged doctor bag rim. The rim is open, and a modular, standard lid interfaces and closes the bag in a water and airtight manner. The lid used in this bag may also be configured to fit the other containers herein, in the nature of the modular design of this versatile container system.

FIG. 23C is a perspective view of a vacuum container with a rigid rim and base and flexible walls with a longitudinally hinged closed doctor bag rim in extended position, where the rim has closed along its longitudinal axis and sealed, without need for a lid. Other advantages of this embodiment include the ability to customize it using the same components as the other embodiments (ex. attaching handles, or compression straps). This bag shares the same dimensions as the others so it would stack and tessellate well with them.

Figure 24:
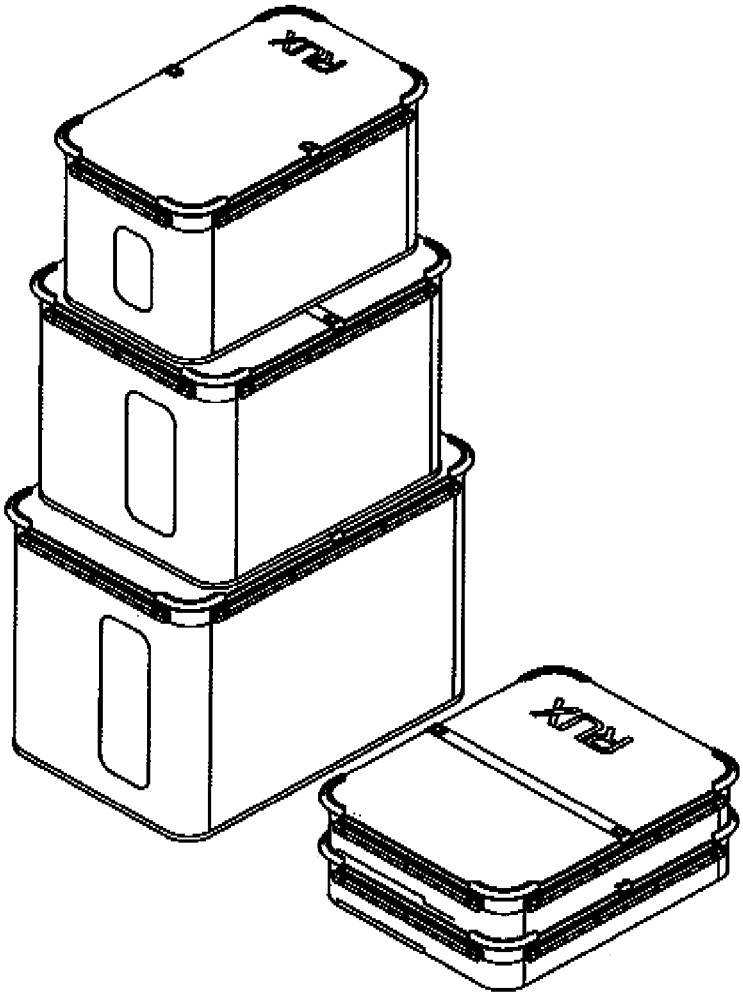
FIG. 24 is a view of several exemplary modular and waterproof storage container in accordance with one aspect of the present disclosure.
Figure 25:
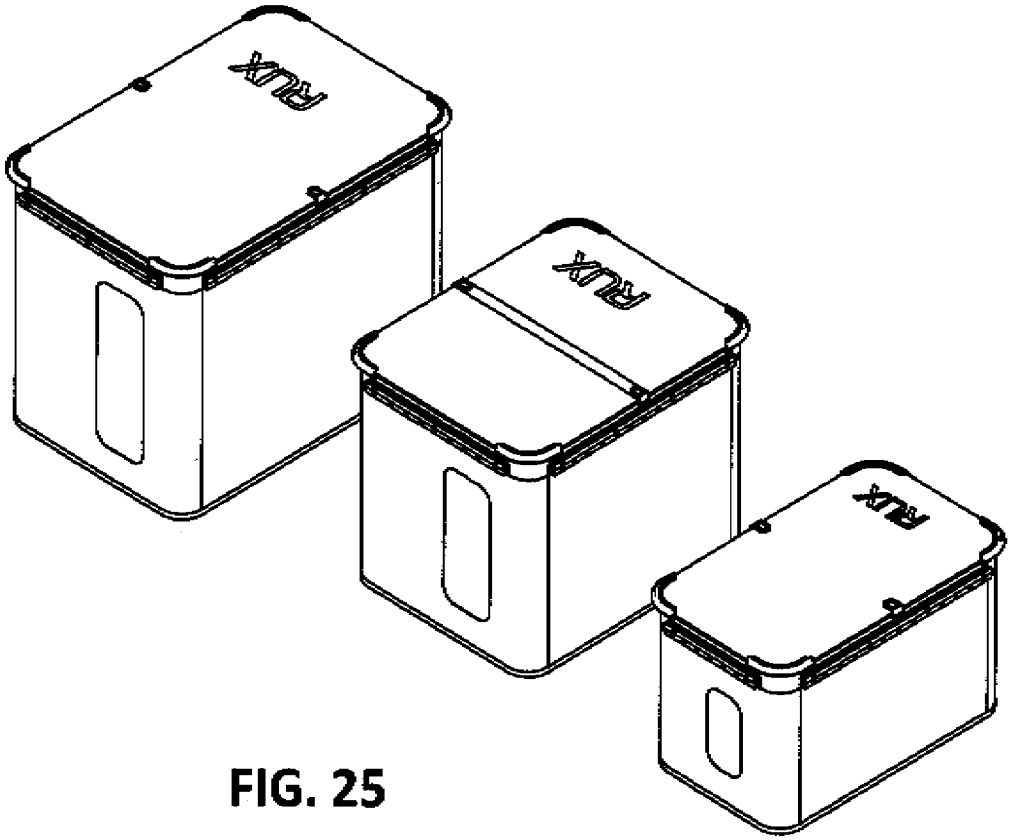
FIG. 25 is a view of several exemplary modular and waterproof storage container in accordance with one aspect of the present disclosure.

FIGS. 24-25 are views of several exemplary modular and waterproof storage container in accordance with one aspect of the present disclosure. As illustrated, these storage containers may be provided in multiple sizes, such as the three different sizes illustrated in this figure. Each of these-containers may be collapsible, as shown, to allow for easy and efficient storage when the container is not in use. The containers are also equipped with a bi-stable mechanism which allows the containers to remain in either a collapsed or an extended position, depending on the needs of a user at a particular time.

Figure 26:
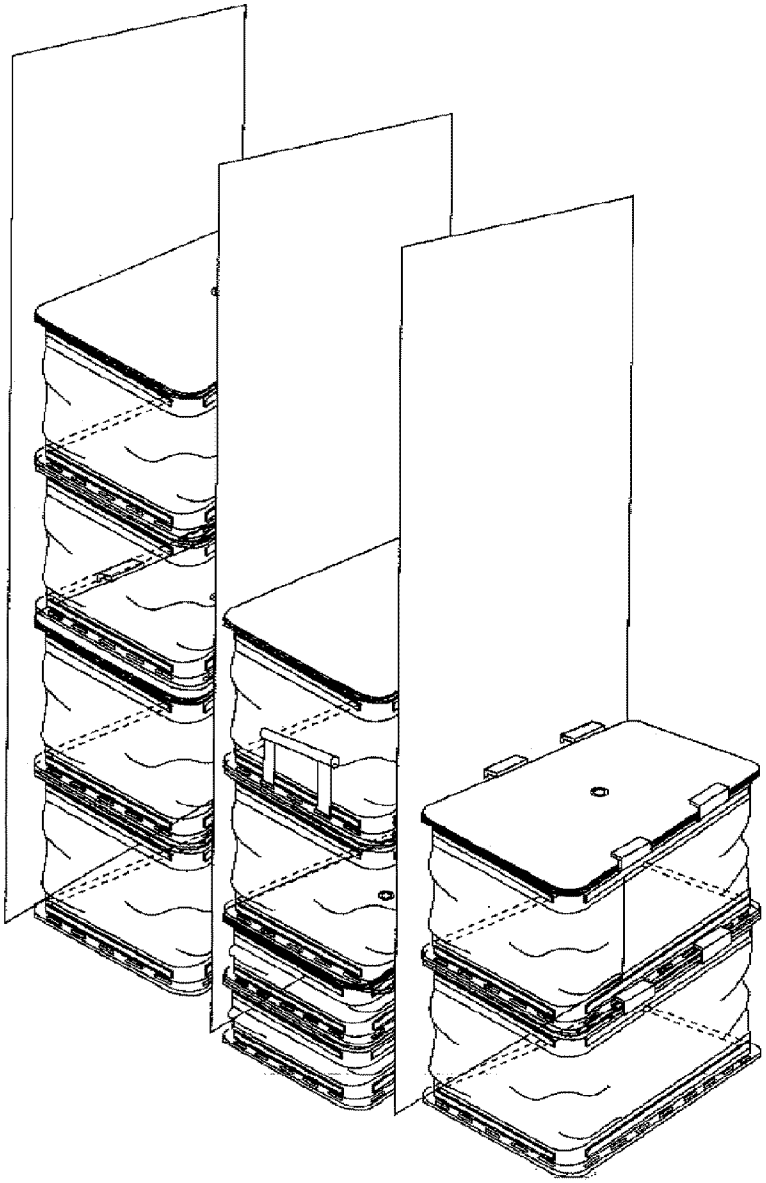
FIG. 26 is a perspective view of exemplary containers in extended or expanded position, stacked in a storage area, in accordance with one aspect of the present disclosure.

FIG. 26 is a perspective view of exemplary containers in extended or expanded position, stacked in a storage area, in accordance with one aspect of the present disclosure.

In operation, the ids, bases, handles, straps and other accessories are interchangeable between the containers. The lids and bases are limited to containers of like size, and a range of sizes is provided for varying applications, such as closet and garage storage, vehicle including car, truck, boat and plane, and mobile applications. The handles and carry straps and other accessories, may be used interchangeably with any of the containers of the present invention. For instance, here, a single handle is shown. The user may have several of the modular containers yet only one set of handles, which may be selectively removed or attached to all of the containers selectively when moving them to a new location.

Figure 27:
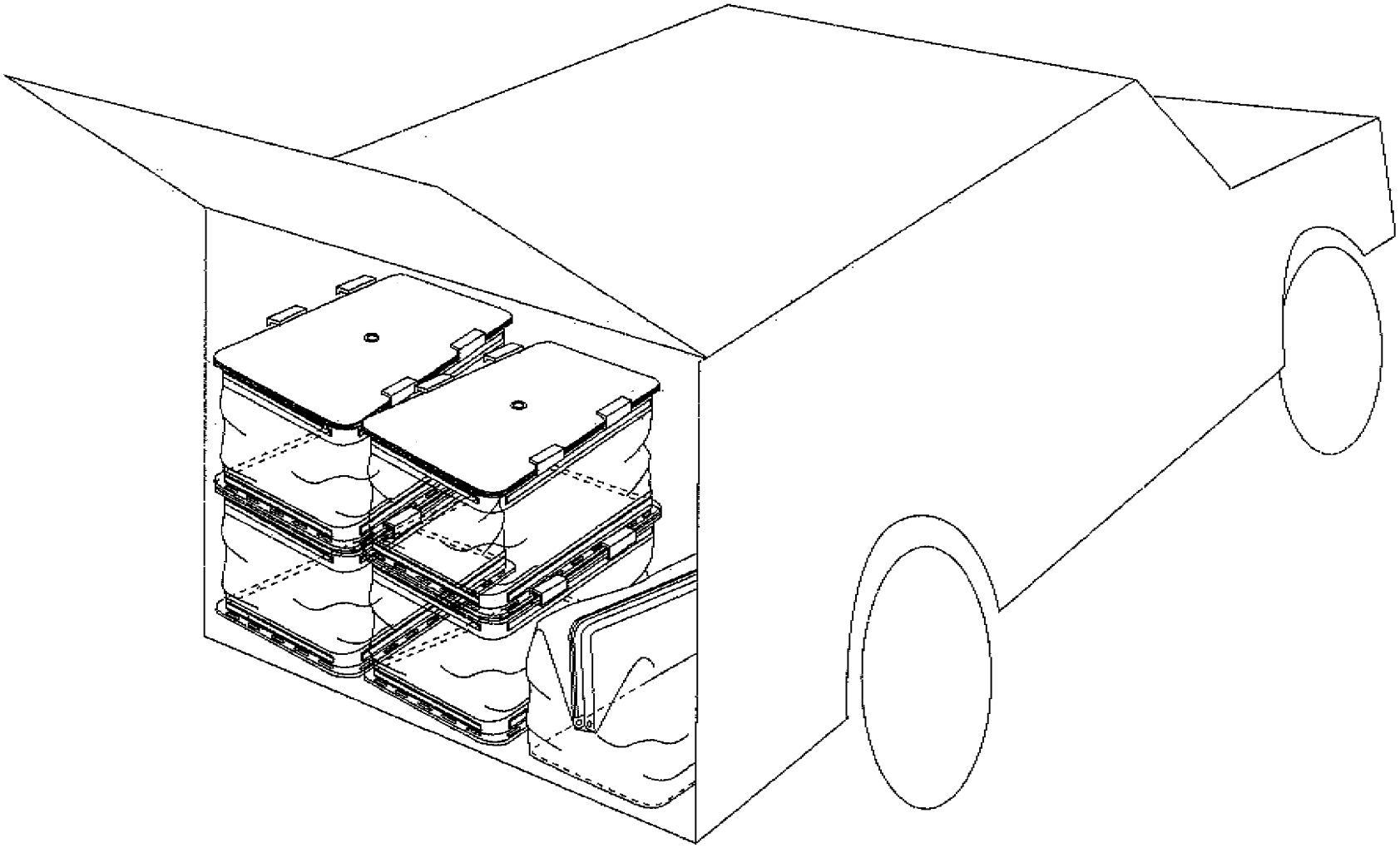
FIG. 27 is a perspective view of the rear cargo area of a vehicle loaded with multiple containers in extended, closed position, in accordance with one aspect of the present disclosure.

FIG. 27 is a perspective view of the rear cargo area of a vehicle loaded with multiple containers in extended, closed position, in accordance with one aspect of the present disclosure.

Figure 28:
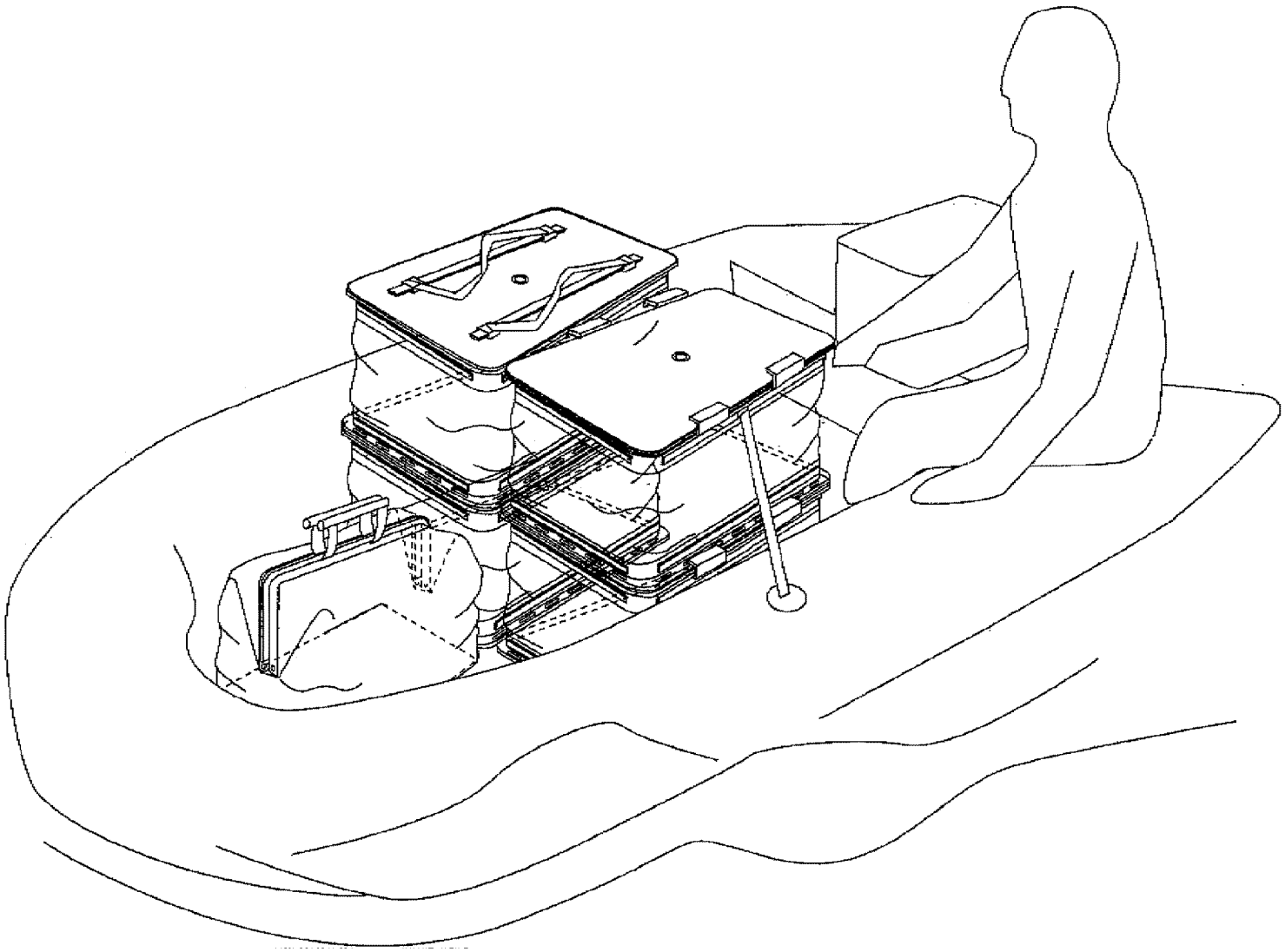
FIG. 28 is a perspective view of the transportation containers in extended and stacked combination in a boat with a user, in accordance with one aspect of the present disclosure.

FIG. 28 is a perspective view of the transportation containers in extended and stacked combination in a boat with a user, in accordance with one aspect of the present disclosure. This illustration depicts a user traveling in a boat, where some of the containers are empty and compressed while other containers are full and expanded. In one aspect, the containers may include air vents which allow them to collapse when they are empty, or to otherwise conform to the shape of their contents rather than remaining "inflated" when they are empty. The air vents may be configured to allow air to escape the container, such as when a gentle force is applied like a user compressing the container, but may remain water-right from the exterior, allowing the contain to retain its waterproof nature.

Figure 29:
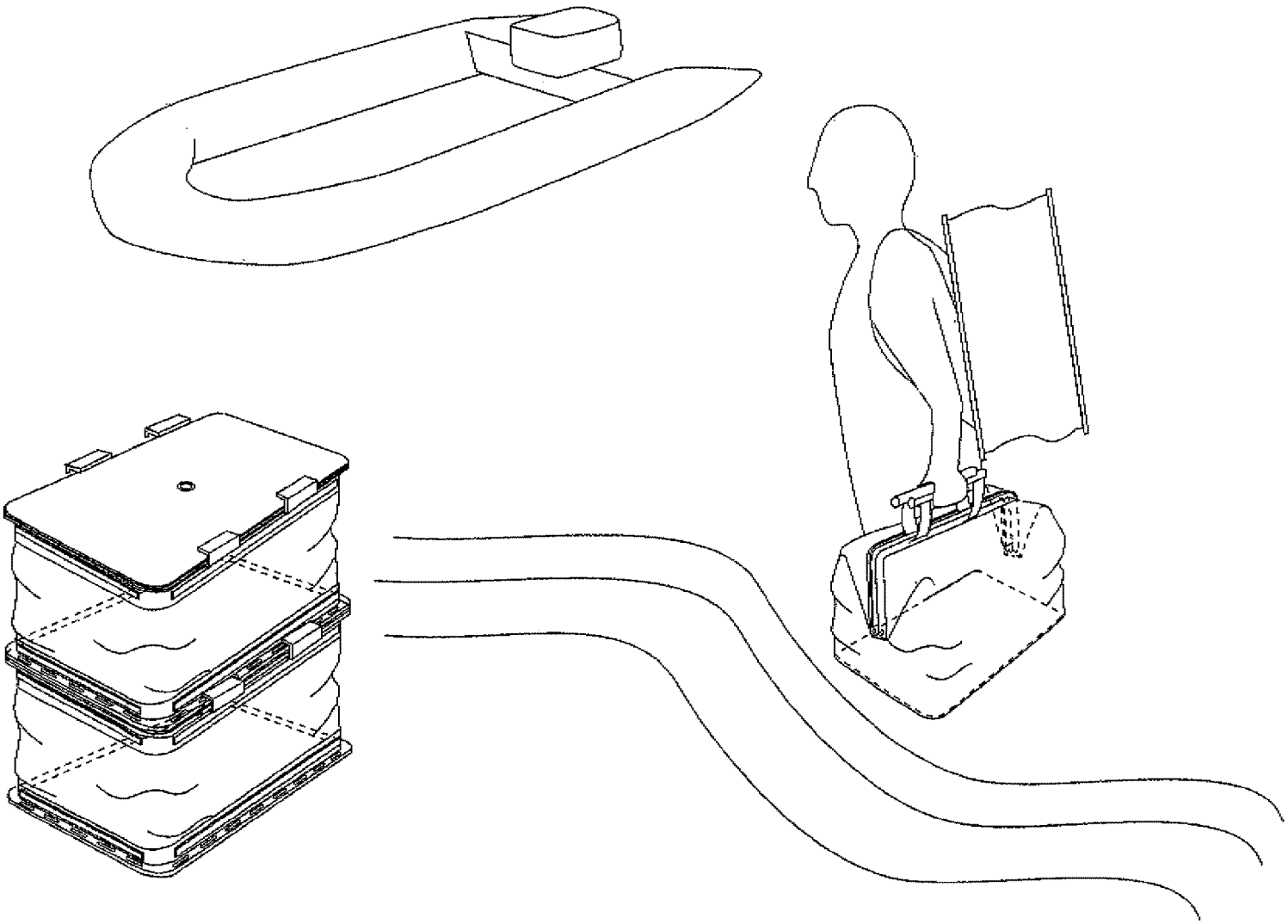
FIG. 29 is a diagrammatic progression perspective view of a user emptying a boat containing exemplary containers by attaching handles and straps, in accordance with one aspect of the present disclosure.

FIG. 29 is a diagrammatic progression perspective view of a user emptying a boat containing exemplary containers by attaching handles and straps, in accordance with one aspect of the present disclosure. FIG. 39 depicts a user traveling in a vehicle 90 such as a boat, using the present invention. On the outbound trip, the user 100 has loaded the containers 10 in the extended or expanded position and filled them with cargo. The containers 10 are in a closed, watertight position, with the container 10 on the top starboard side of the boat 90 bearing removable carry straps 26. The air vents 52 in the center of the lids 12 are also shown, and can be accessed with any conventional vacuum pump to remove the air inside the containers 10 if a vacuum is desired, for instance, for food storage purposes.

In one aspect, the present disclosure describes a versatile storage container which includes a waterproof exterior, including four side walls and a bottom, the four side walls being collapsible to slow the container to take up less space when not in use. The storage container also includes a bi-stable support mechanism configured to allow the container to collapse to a smaller size for storage of the storage container and to expand to a larger size to slow the storage container to be used to store other goods Additionally, a rail system is removably secured to an upper rim of the four side walls, the rail system being configured to removably secure attachments to the versatile storage container and further configured to provide and support a shape of the storage container when the rail system is secured to the upper lip.

The storage container may also include an exterior window in one or more walls of the four side walls, the exterior window being transparent and allowing an interior volume of the storage container to be visible from an exterior of the storage container.

The storage container may also include a removable lid configured to interface with the upper rim of the four side walls to seal the storage container in a watertight and/or airtight manner. The removable lid may include a hinge such that one or more portions of the lid can open while the lid itself remains removably attached to the storage container.

The rim may include two central hinges on opposite portions for the rim, the two central hinges configured to allow the rim to close on itself to seal the storage contain in a watertight manner. The rim may be removably attached to the storage container and comprises a plurality of edge pieces and corner pieces which can be removably secured to one another and to the storage container.

The storage container may also include straps removably connected to the rail system of the storage container, the straps configured to support a weight of the storage container to allow the storage container to be carried using the straps. The storage container may also include mounting clips removably connected to the rail system, the mounting clips configured to support a weight of the storage container to slow the storage container to be mounted to a wall, vehicle, or other surface using the mounting clips. The storage container may also include one or more quick release buckles removably connected to the rail system, the one or more quick release buckles configured to engage with other modular accessories and configured to support a weight of the storage container to allow the weight of the storage container to be carried using the comprising one or more quick release buckles.

The four side walls of the container may be made from one or more of fabric, fabric coated with polyurethane, polyvinyl chloride or silicon, rubber, and plastic.

The bi-stable support mechanism may include four corner pockets, each positioned at an intersection of the side was to one another, the corner pockets configured to receive a support member which allows the four side walls to stand vertically when the support ember is inserted. The support member may be collapsible to allow the storage container to collapse to the smaller size. The bi-stable support mechanism may include a removable collapsing support placed in the interior of the storage container.

The bi-stable support mechanism may include removable braces on the outside of the storage container, the braces configured to collapsible to allow the storage container to collapse to the smaller size and to expand to allow the storage container jo remain in the larger size.

The storage container may also include a removable insulated insert configured to fit within the storage container and to thermally insulate contents of the storage container. The storage container may also include a removable divider configured to separate an interior of the storage container into two or more sections.

The storage container may also include a second storage container configured to be inserted into the storage container, the second storage container being substantially similar in structure to the storage container but with a smaller size. For example, the second storage container may have four collapsible, waterproof side walls and a bottom, but be sized appropriate to fit within the storage container.

The bottom of the storage container may be rigid and may include a bottom rail system configured to allow handles and other accessories to be mounted to the storage container using the bottom rails. The storage container may further include a wheeled handle removably mounted to the bottom rail system, the wheels positioned such that the storage container can roll on the wheels when a user pulls on the handle.

Information as herein shown and described in detail is fully capable of attaining the above-described object of the present disclosure, the presently preferred embodiment of the present disclosure, and is, thus, representative of the subject matter which is broadly contemplated by the present disclosure. The scope of the present disclosure fully encompasses other embodiments which may become obvious to those skilled in the art, and s to be limited accordingly, by nothing other than the appended claims, wherein any reference to an element being made in the singular is not intended to mean "one and only one" unless explicitly so stated, but rather "ono or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

The exemplary embodiments herein described are not intended to be exhaustive or to limit the scope of the disclosure to the precise forms disclosed. They are chosen and described to explain the principles of the disclosure and its application and practical use to Blow others skilled in the art to comprehend its teachings.

As will be apparent to those skilled in the art in light of the foregoing disclosure, many alterations and modifications are possible in the practice of this disclosure without departing from the scope thereof.

What is claimed is:

1. A storage container comprising:

an exterior including four side walls and a bottom, the four side walls collapsible to allow the storage container to take up less space when not in use;

a bi-stable support mechanism coupled to one or more of the four side walls, reconfigurable between at least a first stable configuration and a second stable configuration while coupled to the one or more of the four side walls, wherein the bi-stable support mechanism holds the storage container at a larger size when in the first stable configuration, and allows the container to collapse to a smaller size when in the second stable configuration;

an upper rim secured to an upper portion of the side walls and having a rigid structure for supporting a shape of the storage container; and a rail system secured to the side walls and to the upper rim, comprising one or more rails, including four internal rails and four external rails, with one internal rail extending along an interior of each of the four side walls, and/or one external rail extending along an exterior of each of the four side walls, wherein the four internal rails are not continuous with each other, and the four external rails are not continuous with each other.

2. The storage container of claim 1, further comprising an exterior window in one or more walls of the four side walls, the exterior window being transparent and showing an interior volume of the storage container to be visible from an exterior of the storage container.

3. The storage container of claim 1, further comprising a removable lid configured to interface with the upper rim to seal the storage container in a watertight and/or airtight manner.

4. The storage container of claim 3, wherein the removable lid includes a hinging portion such that one or more portions of the lid can open while the lid itself remains removably attached to the storage container.

5. The storage container of claim 1, wherein the rail system and the upper rim are removably attached to the storage container.

6. The storage container of claim1, further comprising straps removably connected to the rail system of the storage container, the straps configured to support a weight of the storage container to allow the storage container to be carried using the straps.

7. The storage container of claim1, further comprising mounting clips removably connected to the rail system, the mounting clips configured to support a weight of the storage container to allow the storage container to be mounted to a wall, vehicle, or other surface using the mounting clips.

8. The storage container of claim1, further comprising one or more quick release buckles removably connected to the rail system, the one or more quick release buckles configured to engage with other modular accessories and configured to support a weight of the storage container to allow the weight of the storage container to be carried using the one or more quick release buckles.

9. The storage container of claim 1, wherein the four side walls comprise one or more of fabric, rubber, plastic, fabric coated with polyurethane, fabric coated with polyvinyl chloride, and fabric coated with silicon.

10. The storage container of claim 1, wherein the bi-stable support mechanism comprises four support members, each support member inserted in one of four corner pockets, each positioned at an intersection of the side walls to one another, wherein when the support members are extended the four side walls stand vertically to hold the storage container in the first stable configuration, and collapsing the support members configures the storage container to the second stable configuration.

11. The storage container of claim 10, wherein support members comprise bi-stable springs.

12. The storage container of claim 1, wherein the bi-stable support mechanism comprises a removable collapsing support placed in the interior of the storage container.

13. The storage container of claim 1, wherein the bi-stable support mechanism comprises removable braces on the outside of the storage container, the braces configured to be collapsible to allow the storage container to collapse to the smaller size and to expand to allow the storage container to remain in the larger size.

14. The storage container of claim 1, furthering comprising a removable insulated insert configured to fit within the storage container and to thermally insulate contents of the storage container.

15. The storage container of claim 1, furthering comprising a removable divider configured to separate an interior of the storage container into two or more sections.

16. The storage container of claim 1, furthering comprising a second storage container configured to be inserted into the storage container, the second storage container being substantially similar in structure to the storage container but with a smaller size.

17. The storage container of claim 1, wherein the bottom includes a bottom rail system configured to allow handles and other accessories to be mounted to the storage container using the bottom rails.

18. The storage container of claim 17, further comprising a wheeled handle removably mounted to the bottom rail system, the wheels positioned such that the storage container can roll on the wheels when a user pulls on the handle.

19. The storage container of claim 1, wherein the one or more rails further comprise a plurality of receptors for removably securing attachments to the storage container.

20. The storage container of claim 1, wherein the one or more rails are positioned substantially parallel with the top of the side walls.

21. The storage container of claim 1, wherein the one or more rails are spaced apart from the top of the side walls.

22. The storage container of claim 1, wherein the upper rim and the rail system and are disconnectable from each other.

* * * * *